US006551416B1

(12) United States Patent
Herzer

(10) Patent No.: US 6,551,416 B1
(45) Date of Patent: Apr. 22, 2003

(54) METHOD OF ANNEALING AMORPHOUS RIBBONS AND MARKER FOR ELECTRONIC ARTICLE SURVEILLANCE

(75) Inventor: Giselher Herzer, Bruchkoebel (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/703,913

(22) Filed: Nov. 1, 2000

Related U.S. Application Data

(62) Division of application No. 09/262,689, filed on Aug. 4, 1999, now Pat. No. 6,299,702, which is a division of application No. 08/968,653, filed on Nov. 12, 1997, now Pat. No. 6,011,475.

(51) Int. Cl.[7] ..... H01F 1/153

(52) U.S. Cl. ..... 148/108; 29/602.1; 29/25.35; 148/121

(58) Field of Search ..... 148/108, 121; 29/25.35, 602.1; 340/572.1, 572.6

(56) References Cited

U.S. PATENT DOCUMENTS

| | | | | |
|---|---|---|---|---|
| 3,820,040 A | | 6/1974 | Berry et al. | |
| 4,268,325 A | | 5/1981 | O'Handley et al. | |
| 5,469,140 A | | 11/1995 | Liu et al. | |
| 5,565,849 A | * | 10/1996 | Ho et al. | 340/572 |
| 5,628,840 A | | 5/1997 | Hasegawa | |
| 5,728,237 A | | 3/1998 | Herzer | |
| 5,841,348 A | * | 11/1998 | Herzer | 340/551 |
| 6,018,296 A | * | 1/2000 | Herser | 340/572 |

FOREIGN PATENT DOCUMENTS

| | | | |
|---|---|---|---|
| DE | G 94 12 456.6 | | 5/1995 |
| EP | 0 093 28 I | | 11/1983 |
| EP | 0 737 986 | | 4/1995 |
| JP | 56-33461 | * | 4/1981 |
| JP | 59-211530 | * | 11/1984 |
| WO | WO 90/03652 | | 4/1990 |

OTHER PUBLICATIONS

"Metallic Glasses," Chapter 11 ("Magnetic Properties" by Gyorgy), Proc. ASM Seminar, Sep. 1976, Published Jan., 1978, pp. 275–303.

"Ferromagnetismus," Becker et al., Chapter 5, pp. 336–345 (1939).

"Magnetic Annealing and Directional Ordering of an Amorphous Ferromagnetic Alloy," Berry et al., Physical Review Letters, vol. 34 (1975) pp. 1022–1025.

"Ferrogmagnetism," Bozorth, Chapter 13 (1954), pp. 684–707.

"Physics of Magnetism," Chikazumi, Chapter 17, "Induced Magnetic Anisotropy," (1964), pp. 359–361.

"Domain Patters and High–Frequency Magnetic Properties of Amorphous Metal Ribbons," de Wit et al., J. Appl. Phys., vol. 57 (1985), pp. 3560–3562.

(List continued on next page.)

*Primary Examiner*—John Sheehan
(74) *Attorney, Agent, or Firm*—Schiff Hardin & Waite

(57) ABSTRACT

A ferromagnetic resonator for use in a marker in a magnetomechanical electronic article surveillance system has improved magnetoresonant properties and/or reduced eddy current losses by virtue of being annealed so that the resonator has a fine domain structure with a domain width less than about 40 $\mu$m, or less than about 1.5 times the thickness of the resonator. This produces in the resonator an induced magnetic easy axis which is substantially perpendicular to the axis along which the resonator is operated magnetically by a magnetic bias element also contained in the marker. The annealing which produces these characteristics can take place in a magnetic field of at least 1000 Oe, oriented at an angle with respect to the plane of the material being annealed so that the magnetic field has a significant component perpendicular to this plane, a component of at least about 20 Oe across the width of the material, and a smallest component along the direction of transport of the material through the annealing oven.

13 Claims, 23 Drawing Sheets

OTHER PUBLICATIONS

"Magnetic Anisotropy," Fujimori, Chapter 16 in Amorphous Metallic Alloys, Luborsky ed. (1983), pp. 300–316.
"Minimization of Eddy Current Losses in Metallic Glasses by Magnetic Field Heat Treatment," Grimm et al., Proc. of the Soft Magnetic Materials 7 Conference (Blackpool 1985), pp. 332–336.
"Surface Crystallisation and Magnetic Properties in Amorphous Iron Rich Alloys," Herzer et al., "J. Magn. Magn. Mat," vol. 62 Nos. 2 & 3 (Dec. 1986), pp. 143–151.
"Recent Developments in Soft Magnetic Materials," Herzer et al., Physica Scripta, vol. T24 (1988), pp. 22–28.
"Magnetomechanical Damping in Amorphous Ribbons with Uniaxial Anistropy," Herzer, Mat. Sci. and Eng., vol. A226–228 (1997), pp. 631–635.
"Magnetic Properties of Amorphous Ferromagnetic Alloys," Kronmüller et al., J. Mag. Mag. Mat., vol. 13 (1979), pp. 53–70.
Electodynamik der Kontinus, Landau et al., Chapter 7 (1981), pp. 192–197.
"Magnetic Domains in Amorphous Metal Ribbons," Livingston et al., J. Appl. Phys., vol. 57 (1985), pp. 3555–3559.
Magnetomechanical Properties of Amorphous Metals, Livingston, Phys. Status Solidi (a) vol. 70, (91982) pp. 591–596.

"Magnetic Annealing of Amorphous Alloys," Luborsky et al., IEEE Trans. on Magnetics, vol. MAG–11 No. 6 (1975), pp. 1644–1649.

"Magnetic Anneal Anisotropy in Amorphous Alloys," Luborsky et al., IEEE Trans. on Magnetics, vol. MAG–13, No. 2 (1977), pp. 953–956.

"A Magnetoelastic Metallic Glass Low–Frequency Magnetometer," Mermelstein, IEEE Trans. on Magnetics, vol. 28, No. 1, (1992), pp. 36–56.

"Low Coercivity and Zero Magnetostriction of Amorphous Fe–Co–Ni System Alloys," Ohnuma et al., Phys. Status Solidi (a), vol. 44, (1977), pp. K151–K154.

"Demagnetizing Factors of the General Ellipsoid," Osborn, Physical Review, vol. 67, Nos. 11 and 12 (1945) pp. 351–357.

* cited by examiner

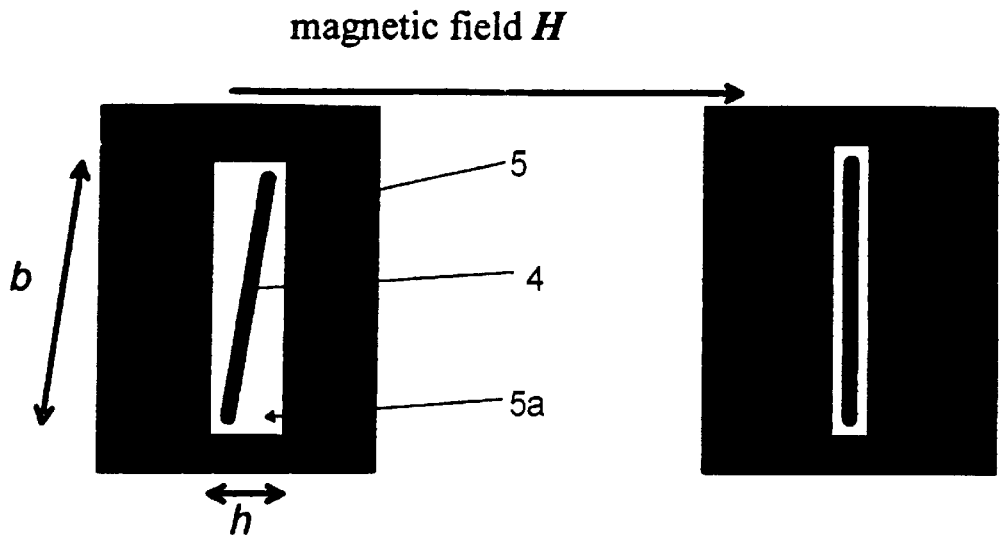
Fig. 16a
Fig. 16b
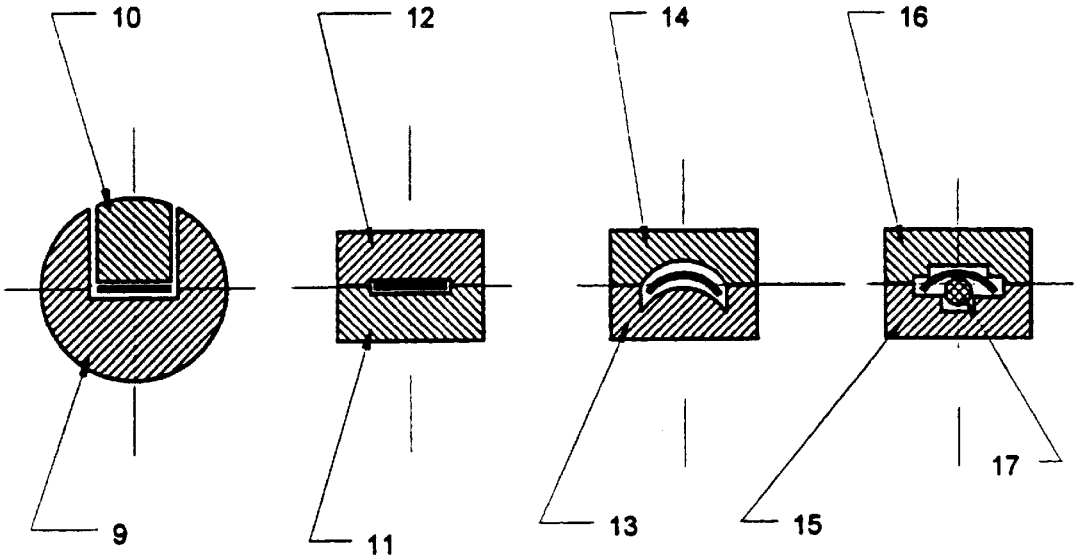
Fig. 17a
Fig. 17b
Fig.17c
Fig.17d

METHOD OF ANNEALING AMORPHOUS RIBBONS AND MARKER FOR ELECTRONIC ARTICLE SURVEILLANCE

The present application is a divisional application of co-pending application Ser. No. 09/262,689, filed Mar. 4, 1999 now U.S. Pat. No. 6,299,702, which is a divisional application of application Ser. No. 08/968,653, filed Nov. 12, 1997, which issued as U.S. Pat. No. 6,011,475.

BACKGROUND OF THE INVENTION

1. Field of the Invention

The present invention relates to magnetic amorphous alloys and to a method of annealing these alloys in a magnetic field. The present invention is also directed to amorphous magnetostrictive alloys for use in a magnetomechanical electronic article surveillance system. The present invention furthermore is directed to a magnetomechanical electronic article surveillance system employing such a marker, as well as to a method for making the amorphous magnetostrictive alloy and a method for making the marker.

2. Description of the Prior Art

It is well known from Chikazumi, Physics of Magnetism (Robert E. Krieger Publishing Company, Malbar, Fla.) chapter 17, p. 359 ff. (1964), for example, that most ferromagnetic alloys exhibit a uniaxial anisotropy when they are heat-treated in a magnetic field whereby the induced magnetic easy axis is parallel to the direction of the annealing field or, more generally, parallel to the domain magnetization during annealing. The aforementioned Chikazumi text gives an example for the magnetization curve of a permalloy (crystalline Fe—Ni alloy) sample measured in a direction perpendicular to the induced magnetic easy axis. Chikazumi notes that in this case the magnetization takes place through a rotation of each magnetic domain giving rise to a linearly ascending magnetization curve.

Luborsky et al., "Magnetic Annealing of Amorphous Alloys", IEEE Trans. on Magnetics MAG-11, p. 1644–1649 (1975) give an early example for magnetic field annealing of amorphous alloys. They transversely field-annealed amorphous $Fe_{40}Ni_{40}P_{14}B_6$ alloy strips in a magnetic field of 4 kOe which was oriented across the ribbon width, i.e. perpendicular to the ribbon axis and in the ribbon plane. After a 2 hrs. treatment at 325° C. and subsequent cooling of 50 deg/min and 0.1 deg/min, for example, they found a hysteresis loop with virtually vanishing remanence and linear dependence of the magnetization versus the applied field up to ferromagnetic saturation which occurs when the applied field equals or exceeds the induced anisotropy field. The authors attributed their observation to the fact that the magnetic field annealing induces a magnetic easy axis transverse to the ribbon direction and that upon applying a magnetic field the magnetization changes by rotation out of this easy axis.

Actually amorphous metals are particularly sensitive to magnetic field annealing owing to the absence of magnetocrystalline anisotropy as a consequence of their glassy non-periodic structure. Amorphous metals can be prepared in the form of thin ribbons by rapidly quenching from the melt which allows a wide range of compositions. Alloys for practical use are basically composed of Fe, Co and/or Ni with an addition of about 15–30 at % of Si and B (Ohnuma et al., "Low Coercivity and Zero Magnetostriction of Amorphous Fe—Co—Ni System Alloys" Phys. Status Solidi (a) vol. 44, pp. K151 (1977)) which is necessary for glass formation. The virtually unlimited miscibility of the transition metals in the amorphous state yields a large versatility of magnetic properties. According to Luborsky et al., "Magnetic Anneal Anisotropy in Amorphous Alloys", IEEE Trans. on Magnetics MAG-13, p. 953–956 (1977) and Fujimori "Magnetic Anisotropy"in F. E. Luborsky (ed) Amorphous Metallic Alloys, Butterworths, London, pp. 300–316 (1983) alloy compositions with more than one metal species are particularly susceptible to the magnetic field anneal treatment. Thus, the magnitude of the induced anisotropy $K_u$ can be varied by choice of the alloy composition as well as by appropriate choice of the annealing temperature and time to range from a few J/m3 up to about 1 kJ/m$^3$. Accordingly the anisotropy field which is given by $H_K=2\ K_u/J_s$ (cf. Luborsky et al., "Magnetic Annealing of Amorphous Alloys", IEEE Trans. on Magnetics MAG-11, p. 1644–1649 (1975); $J_s$ is the saturation magnetization) and which, for a transversely field-annealed material, defines the field up to which the magnetization varies linearly with the applied field before reaching saturation, can be varied from values well below 1 Oe up to values of approximately $H_K \approx 25$ Oe.

The linear characteristics of the hysteresis loop and the low eddy current losses both associated with transversely field-annealed amorphous alloys are useful in a variety of applications such as transformer cores, for example (cf. Herzer et al, "Recent Developments in Soft Magnetic Materials", Physica Scripta vol T24, p 22–28 (1988)). Another field of application where transversely annealed amorphous alloys are particularly useful makes use of their magnetoelastic properties which is described in more detail in the following.

Becker et al., Ferromagnetismus (Springer, Berlin), ch. 5, pp. 336 (1939) or Bozorth, Ferromagnetism (d. van Nostrand Company, Princeton, N.J.) ch. 13, p 684 ff (1951) explain in their textbooks that the magnetostriction associated with rotation of the magnetization vector is responsible for the fact that in ferromagnetic materials Young's modulus changes with the applied magnetic field, which is usually referred to as the ΔE effect.

Consequently U.S. Pat. No. 3,820,040 and Berry et al. "Magnetic annealing and Directional Ordering of an Amorphous Ferromagnetic Alloy", Physical Reviews Letters, vol. 34, p. 1022–1025 (1975) realized that an amorphous Fe-based alloy, when transversely field annealed, exhibits a ΔE effect two orders of magnitude larger than for crystalline iron. They attributed this striking difference to the lack of magnetocrystalline anisotropy in the amorphous alloy, which allows a much greater response to the applied stress by magnetization rotation. They also demonstrated that [a] annealing in a longitudinal field largely suppresses the ΔE effect since in this condition the domain orientations are not susceptible to stress-induced rotation. In the Berry et al. 1975 article it is recognized that the enhanced ΔE effect in amorphous metals provides a useful means to achieve control of the vibrational frequency of an electromechanical oscillator with the help of an applied magnetic field.

The possibility to control the vibrational frequency by an applied magnetic field was found to be particularly useful in European Application 0 093 281 for markers for use in electronic article surveillance (EAS). The magnetic field for this purpose is produced by a magnetized ferromagnetic strip (bias magnet) disposed adjacent to the magnetoelastic resonator, with the strip and resonator being contained in a marker or tag housing. The change in effective magnetic permeability of the marker at the resonance frequency provides the marker with signal identity. This signal identity can be removed by changing the resonant frequency by means of the applied field. Thus the marker can, for example, be deactivated by degaussing the bias magnet, which removes the applied magnetic field, and thus changes the resonant frequency appreciably. Such systems originally (cf. European Application 0 093 281, and Application PCT WO 90/03652) used markers made of amorphous ribbons in the "as prepared" state which also can exhibit an appreciable ΔE effect owing to uniaxial anisotropies associated with production-inherent mechanical stresses.

U.S. Pat. No. 5,469,140 discloses that the application of transverse field annealed amorphous magnetomechanical elements in electronic article surveillance systems removes a number of deficiencies associated with the markers of the prior art which use as prepared amorphous material. In an example, this patent describes a linear behavior of the hysteresis loop up to an applied field of at least about 10 Oe. This linear behavior associated with the transverse field annealing avoids the generation of harmonics which can produce undesirable alarms in other types of EAS systems (i.e., harmonic systems). Such interference with harmonic systems actually is a severe problem with the aforementioned magneto-elastic markers of the prior art, due the non-linear hysteresis loop typical associated with the as prepared state of amorphous alloys, since it is this non-linear behavior which (undesirably) triggers an alarm in a harmonic EAS system. This patent further teaches that heat treatment in a magnetic field significantly improves the consistency in terms of the resonant frequency of the magnetostrictive strips. A further advantage of such annealed resonators is their higher resonant amplitude. This patent also teaches that a preferred material is an Fe—Co alloy which contains at least about 30 at % Co, whereas earlier materials of the prior art such as $Fe_{40}Ni_{38}Mo_3B_{18}$, disclosed in the aforementioned PCT Application WO 90/03652 are unsuitable in pulse-field magnetomechanical EAS systems since annealing such materials undesirably reduces the ring down period of the signal. In German Gebrauchsmuster G 94 12 456.6 the present inventor recognized that a long ring-down time can be achieved by choosing an alloy composition which reveals a relatively high induced magnetic anisotropy and that, therefore, such alloys are particularly suited for magnetoelastic markers in article surveillance systems. Herzer teaches that the desired high ring-down times can be also achieved at lower Co-contents down to about 12 at % if, starting from a Fe—Co-based alloy, up to about 50% of the Fe and/or Co is substituted by Ni. The need for a linear loop with relatively high anisotropy and the benefit of alloying Ni in order to reduce the Co-content for such magnetoelastic markers was later on reconfirmed by the disclosure of U.S. Pat. No. 5,628,840.

The field annealing in the aforementioned examples was done across the ribbon width i.e. the magnetic field direction was oriented perpendicular to the ribbon axis and in the plane of the ribbon surface. This technique will be referred to herein, and is known in the art, as transverse field-annealing. The strength of the magnetic field has to be strong enough in order to saturate the entire ribbon ferromagnetically across the ribbon width. This can be achieved in magnetic fields as low as a few hundred Oe. Such transverse field-annealing can be performed, for example, batch-wise either on toroidally wound cores or on pre-cut straight ribbon strips. Alternatively, and as disclosed in detail in U.S. Pat. No. 5,469,140, the annealing can be performed in a continuous mode by transporting the alloy ribbon from one reel to another reel through an oven in which a transverse saturating field is applied to the ribbon.

The change of magnetization by rotation and the associated magnetoelastic properties are primarily related to the fact that there is a uniaxial anisotropy axis perpendicular to the applied operational magnetic field. The anisotropy axis need not necessarily be in the ribbon plane like in the case of the transversely field annealed samples; the uniaxial anisotropy can also be caused by mechanisms other than field annealing. A typical situation is, for example, that the anisotropy is perpendicular to the ribbon plane. Such an anisotropy can arise again from magnetic field annealing but this time in a strong field oriented normal to the ribbon's plane, as taught by Gyorgy, in Metallic Glasses, 1978, Proc. ASM Seminar Sept. 1976 (American Society for Metals, Metals Park, Ohio) ch. 11, pp 275–303, U.S. Pat. No. 4,268,325, Grimm et al., 1985, "Minimization of Eddy Current Losses in Metallic Glasses by Magnetic Field Heat Treatment", Proceedings of the SMM 7 conference in Blackpool (Wolfson Centre for Magnetics Technology, Cardiff) p. 332–336, de Wit et al., 1985 "Domain patterns and high-frequency magnetic properties of amorphous metal ribbons" J. Appl. Phys. vol 57, pp. 3560–3562 (1985), and Livingston et al., "Magnetic Domains in Amorphous Metal ribbons", J. Appl. Phys. vol. 57, pp 3555–3559 (1985), which hereafter will be referred to as perpendicular field-annealing. Other sources of such a perpendicular anisotropy can arise from the magnetostrictive coupling with internal mechanical stresses associated with the production process (see the aforementioned Livingston et al., "Magnetic Domains in Amorphous Metal ribbons" article and the aforementioned chapter by Fujimori in F. E. Luborsky (ed)) or e.g. induced by partial crystallization of the surface (Herzer G. "Surface Crystallization and Magnetic Properties in Amorphous Iron Rich Alloys", J. Magn. Magn. Mat., vol. 62, p. 143–151 (1986)).

When the magnetic easy axis is perpendicular to the ribbon plane, the large demagnetization factor requires very fine domain structures in order to reduce magnetostatic stray field energy (cf. Landau et al. in Electrodynamics of Continuous Media, Pergamon, Oxford, England, ch 7. (1981)). Domain widths observed are typically 10 μm or less and the visible domains are generally closure domains while ribbons with an anisotropy across the ribbon width exhibit wide transverse slab domains, typically about 100 μm in width (as taught by the aforementioned Gyorgy article and the aforementioned de Wit et al. article, and Mermelstein, "A Magnetoelastic Metallic Glass Low-Frequency Magnetometer", IEEE Transactions on Magnetics, vol. 28, p. 36–56 (1992)).

One of the first examples for perpendicular field annealing was given in the aforementioned article by Gyorgy in which, for a Co-based amorphous alloy, the domain structure after said annealing treatment is compared with that obtained after a transverse field-anneal treatment and a longitudinal field anneal treatment, respectively. Gyorgy states that the domain structure of the perpendicularly annealed sample is typical for a uniaxial material with the easy axis normal to the surface.

The latter finding was confirmed in the aforementioned de Wit et al. article wherein two samples of a near-zero magnetostrictive amorphous Co-base alloy are compared, one having been transversely field-annealed in a field of 0.9 kOe and the other having been perpendicularly field annealed in a field of 15 kOe. de Wit et al. found that, as already mentioned above, in both cases the magnetization process is controlled by rotation which results in an essentially linear behavior of the magnetization with the applied field. The aforementioned Mermelstein article reaches a similar conclusion for a highly magnetostrictive amorphous Fe-based ribbon which was transversely and perpendicularly field-annealed, respectively, in a magnetic field of 8.8 kOe.

Mermelstein posits that in both cases the magnetization process is controlled by rotation of the magnetization vector towards the applied field, and thus concludes it is sufficient to use a single model in order to describe the magnetic and magnetoelastic properties as well as the effect of eddy currents in both cases. Mermelstein's investigations were directed to a magnetoelastic field sensor using these samples and he concludes that both types of domain structures exhibit nominally equivalent noise baselines and that any differences in the sensor's sensitivity are only to be attributed to the differing anisotropy fields associated with dissimilarities in the heat treatment.

Still, as noted above de Wit et al. found that although essentially linear, the hysteresis loop of the perpendicularly annealed sample revealed a non-linear opening in its center region which is accompanied by enhanced eddy current losses, unlike the transversely annealed sample. This finding has been confirmed in the aforementioned Grimm et al., article which reports investigation of the perpendicular anisotropy in amorphous FeCo- and FeNi-based alloys induced by annealing in a magnetic field of 9 kOe oriented normal to the ribbon surface. Grimm et al. attribute this non-linearity to switching processes in the closure domains. Only in the case of the sample which had the highest magnetostriction ($\lambda_s \approx 22$ ppm) did they find a substantially linear magnetization loop with negligible hysteresis and considerably reduced eddy current losses. They found that in this case magnetostrictive interactions favor the closure domains to be oriented perpendicular to the applied field, which results in a less complex magnetization process within the closure domains. In contrast, the closure domain stripes are oriented parallel to the applied field for samples with lower magnetostriction constants (i.e. about 9 ppm in one example or a near-zero magnetostrictive sample), which results in the aforementioned non-linearity in the hysteresis loop's center region.

Comparable results also have been disclosed in the aforementioned U.S. Pat. No. 4,268,325 which describes annealed ring-laminated, toroidal cores assembled from punchouts from a 2 cm wide amorphous glassy $Fe_{40}Ni_{40}B_{20}$ ribbon in a perpendicular field of 2 kOe and a circumferential field of 1 Oe. According to this patent, the application of such a perpendicular field during annealing results in a sheet having an easy magnetic axis essentially normal to the sheet plane. The result was a relatively linear magnetization loop but again with a non-linear opening in its center region and enhanced AC losses. The aforementioned U.S. Pat. No. 4,268,325, moreover, teaches that it is advantageous to apply in a second annealing step a magnetic field normal to the direction of the first field in order to minimize AC hysteresis losses. Indeed the losses of the cited sample could be improved by subsequent annealings in a circumferential field. This second annealing step increases the remanence, and thus the non-linearity, and led to a minimum at an enhanced remanence of about 3.5 kG where the hysteresis loop was substantially non-linear.

All these observations teach that no real benefit is associated with perpendicular field-annealing over transverse field-annealing. Indeed, transverse field-annealing seems to be clearly advantageous if a linear hysteresis loop and low eddy current losses are required for whatever application. Moreover, transverse field-annealing is much easier to conduct experimentally than perpendicular field-annealing due in part to the field strengths needed to saturate the ribbon ferromagnetically in the respective cases in order to obtain a uniform anisotropy. Owing to their magnetic softness, amorphous ribbons can be generally saturated ferromagnetically in internal magnetic fields of a few hundred Oersteds. The internal magnetic field in a sample with finite dimensions, however, is composed of the externally applied field and the demagnetizing field, which acts opposite to the applied field. While the demagnetizing field across the ribbon width is relatively small, the demagnetizing field normal to the ribbon plane is fairly large and, for a single ribbon, almost equals the component of the saturation magnetization normal to the ribbon plane. Accordingly, in the aforementioned U.S. Pat. No 4,268,325 it is taught that the strength of the perpendicularly applied magnetic field preferably should be at least about 1.1 times the saturation induction at the annealing temperature. This is typically accomplished by a field strength of about 10 kOe or more as reported in the aforementioned papers relating to perpendicular field annealing. In comparison transverse field-annealing can be successfully done in considerably lower fields in excess of a few hundred Oe only. The aforementioned U.S. Pat. No. 5,469,140 as well as European Application 0 737 986, for example, teach that for transverse field-annealing a field strength in excess of 500 Oe or 800 Oe is enough to achieve saturation. Of course such a moderate field can be realized in a much easier and a more economic way than the high fields necessary for perpendicular annealing. Thus, lower magnetic fields allow a wider gap in the magnet, which facilitates the construction of the oven which has to be placed within this gap. If the field is produced by an electromagnet, moreover, the power consumption is reduced. For a yoke built of permanent magnets lower field strengths can be realized with less and/or cheaper magnets.

SUMMARY OF THE INVENTION

According to the state of the prior art discussed above, the transverse field-annealing method seems to be much more preferable over the perpendicular field-annealing method for a variety of reasons. The present inventor has recognized, however, that an annealing method in which the magnetic field applied during annealing has a substantial component out of the ribbon plane may, if properly performed, yield much better magnetic and magneto-elastic properties than the conventional methods taught by the prior art.

It is an object of the present invention to provide a method of reducing the eddy current losses of a ferromagnetic ribbon which in operation is magnetized by a static magnetic bias field.

More specifically it is an object of the present invention to provide a magnetostrictive alloy, and a method for annealing same, in order to produce a resonator having properties suitable for use in a magnetomechanical electronic surveillance system with better performance than conventional resonators.

It is another objective of this invention to provide such a magnetostrictive amorphous metal alloy for incorporation in a marker in a magnetomechanical surveillance system which can be cut into an oblong, ductile, magnetostrictive strip which can be activated and deactivated by applying or removing a pre-magnetization field H and which, in the activated condition can be excited by an alternating magnetic field so as to exhibit longitudinal, mechanical resonance oscillations at a resonant frequency $f_r$ which after excitation are of high signal amplitude.

It is a further object of this invention to provide such an alloy wherein only a slight change in the resonant frequency $f_r$ occurs given a change in the magnetization field strength.

A further object is to provide such an alloy wherein the resonant frequency $f_r$ changes significantly when the marker resonator is switched from an activated condition to a deactivated condition.

Another object of the present invention is to provide such an alloy which, when incorporated in a marker for a magnetomechanical surveillance system, does not trigger an alarm in a harmonic surveillance system.

It is also an object of this invention to provide a marker embodying such a resonator, and a method for making a marker, suitable for use in a magnetomechanical surveillance system.

Another object of this invention is to provide a magnetomechanical electronic article surveillance system which is operable with a marker having a resonator composed of such an amorphous magnetostrictive alloy.

The above objects are achieved in a resonator, a marker embodying such a resonator and a magnetomechanical article surveillance system employing such a marker, wherein the resonator is an amorphous magnetostrictive alloy and wherein the raw amorphous magnetostrictive alloy ribbon is annealed in a such a way that a fine domain structure is formed with a domain width less than about 40 $\mu$cm or 1.5 times the thickness of the ribbon, and that an anisotropy is induced which is perpendicular to the ribbon axis and points out of the ribbon plane at an angle larger than 50 up to 90° with respect to the ribbon plane. The lower bound for the anisotropy angle is necessary to achieve the desired refinement of the domain structure which is necessary to reduce eddy current losses, and thus improves the signal amplitude, and hence improves the performance of the electronic article surveillance system using such a marker.

This can be accomplished, for example, in an embodiment of the invention wherein crystallinity is introduced from the top and bottom surfaces of the ribbon or strip to depth of about 10% of the strip or ribbon thickness at each surface, which results in an anisotropy perpendicular to the ribbon axis and perpendicular to the ribbon plane. Thus, as used herein, "amorphous" (when referring to the resonator) means a minimum of about 80% amorphous (when the resonator is viewed in a cross-section). In another embodiment a saturating magnetic field is applied perpendicular to the ribbon plane such that the magnetization is aligned parallel to that field during annealing. Both treatments result in a fine domain structure, an anisotropy perpendicular to the ribbon plane and a substantially linear hysteresis loop. As used herein "substantially linear"includes the possibility of the hysteresis loop still exhibiting a small non-linear opening in its center. Although such a slightly non-linear loop triggers fewer false alarms in harmonic systems compared to conventional markers, it is desirable to virtually remove the remaining non-linearity.

Therefore, the annealing is preferably done in such a way that the induced anisotropy axis is at an angle less than 90° with respect to the ribbon plane, which yields an almost perfectly linear loop. Such an "oblique" anisotropy can be realized when the magnetic annealing field has an additional component across the ribbon width.

Thus the above objects can be achieved preferably by annealing the amorphous ferromagnetic metal alloy in a magnetic field of at least about 1000 Oe oriented at an angle with respect to the ribbon plane such that the magnetic field has one significant component perpendicular to the ribbon plane, one component of at least about 20 Oe across the ribbon width and a nominally negligible component along the ribbon axis to induce a magnetic easy axis which is oriented perpendicular to the ribbon axis but with a component out of the ribbon plane.

The oblique magnetic easy axis can be obtained, for example, by annealing in a magnetic field having a field strength which is sufficiently high so as to be capable of orienting the magnetization along its direction and at an angle between about 100 and 80° with respect to a line across the ribbon width. This, however requires very high field strengths of typically around 10 kOe or considerably more, which are difficult and costly in realization.

A preferred method in order to achieve the above objects therefore includes applying a magnetic annealing field whose strength (in Oe) is lower than the saturation induction (in Gauss) of the amorphous alloy at the annealing temperature. This field, typically 2 kOe to 3 kOe in strength, is applied at angle between about 60° and 89° with respect to a line across the ribbon width. This field induces a magnetic easy anisotropy axis which is parallel to the magnetization direction during annealing (which typically does not coincide with the field direction for such moderate field strengths) and which is finally oriented at angle of at least about 5–10° out of the ribbon plane and, at the same time, perpendicular to the ribbon axis.

Apart from its direction, the aforementioned oblique anisotropy is independently characterized by its magnitude which is in turn characterized by the anisotropy field strength $H_k$. As described earlier the direction is primarily set by the orientation and strength of the magnetic field during annealing. The anisotropy field strength (magnitude) is set by a combination of the annealing temperature-time profile and the alloy composition, with the order of anisotropy magnitude being primarily varied (adjusted) by the alloy composition with changes from an average (nominal) magnitude then being achievable within about +/−40% of the nominal value by varying (adjusting) the annealing temperature and/or time.

A generalized formula for the alloy composition which, when annealed as described above, produces a resonator having suitable properties for use in a marker in an electronic magnetomechanical article surveillance or identification system, is as follows, $Fe_aCo_bNi_cSi_xB_yM_z$ wherein a, b , c, y, x, and z are in at %, wherein M is one or more glass formation promoting element such as C, P, Ge, Nb, Ta and/or Mo and/or one or more transition metals such as Cr and/or Mn and wherein $15<a<75$ $0<b<40$ $0\leqq c<50$ $15<x+y+z<25$ $0\leqq z<4$ so that $a+b+c+x+y+z=100$.

The detailed composition has to be adjusted to the individual requirements of the surveillance system. Particularly suited compositions generally reveal a saturation magnetization $J_s$ at the annealing temperature which is preferably less then about 1 T (=10 kG) and/or a Curie temperature $T_c$ ranging from about 350° C. to about 450° C. Given these limits, more appropriate Fe, Co and Ni contents can be selected e.g. from the data given by Ohnuma et al., "Low Coercivity and Zero Magnetostriction of Amorphous Fe=13 Co—Ni System Alloys" Phys. Status Solidi (a) vol. 44, pp. K151 (1977). In doing so one should have in mind that, $J_s$ and $T_c$ can be decreased or increased by increasing or decreasing the sum of x+y+z, respectively. Preferably, those compositions should be generally selected which, moreover, when annealed in a magnetic field, have an anisotropy field of less than about 13 Oe.

For one major electronic article surveillance system on the market, the desired objects of the inventions can be realized in a particularly advantageous way by applying the following ranges to the above formula $15<a<30$ $10<b<30$ $20<c<50$ $15<x+y+z<25$ $0\leqq z<4$ and even more preferably $15<a<27$ $10<b<20$ $30<c<50$ $15<x+y+z<20$ $0<x<6$ $10<y<20$ $0\leqq z<3$ Examples of such particularly suited alloys for this EAS system have e.g. a composition such as $Fe_{24}Co_{18}Ni_{40}Si_2B_{16}$, $Fe_{24}Co_{16}Ni_{43}Si_1B_{16}$ or $Fe_{23}Co_{15}Ni_{45}Si_1B_{16}$, a saturation magnetostriction between about 5 ppm and about 15 ppm, and/or when annealed as described above have an anisotropy field of about 8 to 12 Oe. These examples in particular exhibit only a relatively slight change in the resonant frequency $f_r$ given a change in the magnetization field strength i.e. $|df/dH|<700$ Hz/Oe but at the same time the resonant frequency $f_r$ changes significantly by at least about 1.4 kHz when the marker resonator is switched from an activated condition to a deactivated condition. In a preferred embodiment such a resonator ribbon has a thickness less than about 30 $\mu$m, a length of about 35 mm to 40 mm and a width less then about 13 mm preferably between about 4 mm to 8 mm i.e., for example, 6 mm.

Other applications such as electronic identification systems or magnetic field sensor rather require a high sensitivity of the resonant frequency to the bias field i.e. in such case a high value of $|df/dHI>$1000Hz/Oe is required. Examples of particularly suited compositions for this case have e.g. a composition such as $Fe_{62}Ni_{20}Si_2B_{16}$, $Fe_{40}Co_2Ni_{40}Si_5B_{13}$, $Fe_{37}Co_5Ni_{40}Si_2B_{16}$or $Fe_{32}Co_{10}Ni_{40}Si_1B_{16}$, a saturation magnetostriction larger than about 15 ppm and/or when annealed as described above have an anisotropy field ranging from about 2 Oe to about 8 Oe.

Additionally, the reduction of eddy current losses by means of the heat treatment described herein can be of benefit for non-magneto-elastic applications and can enhance the performance of a near-zero magnetostrictive Co-based alloy when used e.g. in toroidally wound cores operated with a pre-magnetization generated by a DC current.

DESCRIPTION OF THE DRAWINGS

FIG. 1*a* is a schematic sketch of this domain structure and FIG. 1*b* is an experimental example of this domain structure for an amorphous $Fe_{24}Co_{18}Ni_{40}Si_2B_{16}$ alloy annealed for about 6 s at 350° C. in a transverse field of about 2 kOe.

[FIG. 2*a* is a schematic sketch of this domain structure and]

FIG. 6*a* is a schematic sketch of the ribbon's cross section (across the ribbon width) and illustrates the orientation of the magnetic field vector and the magnetization during annealing; FIG. 6*b* shows the theoretically estimated angle $\beta$ of the magnetization vector during annealing as a function of the strength and orientation of the applied annealing field. The field strength H is normalized to the saturation magnetization $J_s$ ($T_a$) at the annealing temperature.

FIG. 8*a* is a schematic sketch of this domain structure; FIG. 8*b* is an experimental example of such a domain structure for an amorphous $Fe_{24}Co_{18}Ni_{40}Si_2B_{16}$ alloy annealed for about 6 s at 350° C. in a magnetic field of about 3 kOe strength and oriented at an angle of about 88° with respect to the ribbon plane and at the same time perpendicular to the ribbon axis.

FIG. 9*a* shows the hysteresis loop which is linear almost up to saturation at $H_k$; FIG. 9*b* shows the resonant frequency $f_r$ and the resonant amplitude A1 as a function of a static magnetic bias field H; the particular example shown here is to a 38 mm long, 6 mm wide and appr. 25 μm thick strip cut from an amorphous $Fe_{24}Co_{18}Ni_{40}Si_2B_{16}$ alloy annealed for about 6 s at 360° C. in a magnetic field of about 2 kOe strength and oriented at an angle of about 85° with respect to the ribbon plane and simultaneously perpendicular to the ribbon axis.

FIG. 11*a* shows the maximum resonant signal amplitude and the resonant signal amplitude at the bias field where the resonant frequency $f_r$ exhibits its minimum; FIG. 11*b* shows the domain size and the estimated angle of the magnetic easy axis with respect to the ribbon plane; FIG. 11*c* shows the anisotropy field; region II represents one preferred embodiment of the invention; the particular results shown in this figure was obtained for an amorphous $Fe_{24}Co_{18}Ni_{40}Si_2B_{16}$ alloy annealed for about 6 s at 350° C.

FIG. 12*a* shows the typical form of the hysteresis loop in its center part when annealed in a "perpendicular" field of a strength larger and smaller than the saturation magnetization at the annealing temperature, respectively; FIG. 12*b* shows the evaluation of the linearity of the hysteresis loop with the applied annealing field strength in terms of the coercivity $H_c$ of the annealed ribbons; the results shown were obtained for an amorphous $Fe_{24}Co_{18}Ni_{40}Si_2B_{16}$ alloy annealed for about 6 s at 350° C.

FIG. 13*a* shows the maximum resonant signal amplitude and FIG. 13*b* shows the resonant signal amplitude at the bias field where the resonant frequency $f_r$ exhibits its minimum; the particular results shown were obtained for an amorphous $Fe_{24}Co_{18}Ni_{40}Si_2B_{16}$ alloy annealed in a continuous mode for about 6 s at 350° C. in a magnetic field of orientation and strength as indicated in the figure.

FIG. 15*a* shows the hysteresis loop and the prevailing magnetization processes; FIG. 15*b* shows the resonant frequency $f_r$ and the resonant amplitude A1 as a function of a static magnetic bias field H; the particular example shown is a 38 mm long, 6 mm wide and appr. 25 μm thick strip cut from an amorphous $Fe_{24}Co_{18}Ni_{40}Si_2B_{16}$ alloy annealed for about 6 s at 360° C. in a magnetic field of about 2 kOe strength and oriented "ideally" perpendicular to the ribbon plane such that no appreciable transverse field component was present.

FIGS. 16*a* and 16*b* respectively show cross sections through an annealing fixture in accordance with the inventive method which guides the ribbon through the oven; FIG. 16*a* demonstrates how the ribbon is oriented in the magnetic field if the opening is significantly wider than the ribbon thickness; FIG. 16*b* shows a configuration wherein the ribbon is oriented perfectly perpendicular to the applied annealing field in a strict geometrical sense.

FIGS. 17*a*, 17*b*, 17*c* and 17*d* respectively show different cross sections of some typical realizations of the annealing fixture in the inventive method.

FIG. 19*a* shows the cross section of a magnet system with an oven in-between, in which the ribbon is transported at a desired angle with respect to the field direction by an annealing fixture 5; FIG. 19*b* shows a longitudinal section of the magnet system and the oven inside the magnet; the ribbon is supplied from a reel, transported through the oven by the rollers which are driven by a motor, and is finally wound on another reel with orientation of the ribbon within the magnetic field being supported by an annealing fixture.

FIG. 22*a* shows the maximum amplitude A1 and FIG. 22*b* shows the amplitude at the bias field where the resonant frequency has its minimum.

DESCRIPTION OF THE PREFERRED EMBODIMENTS

Alloy preparation

Figure 1A:
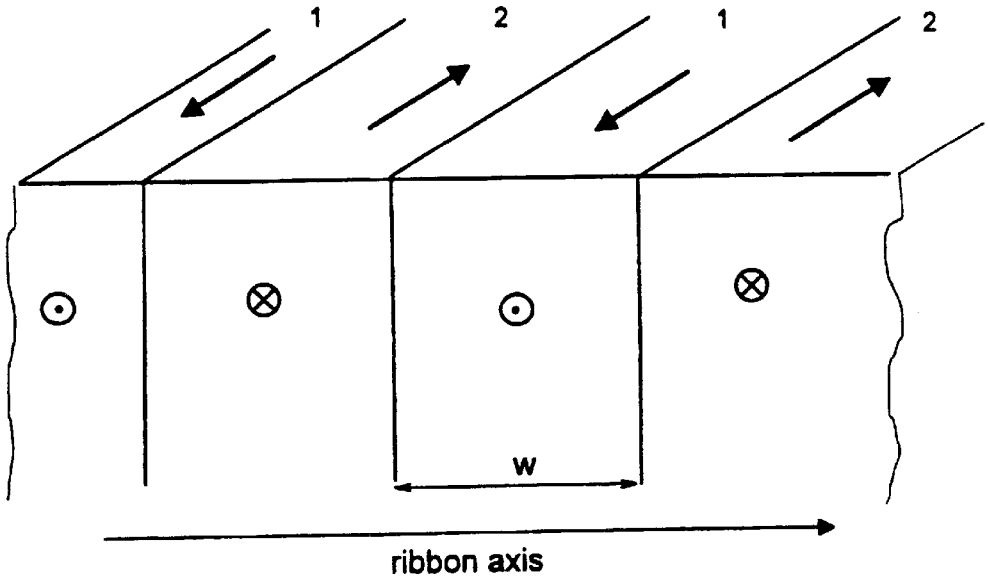
Fig. 1a (PRIOR ART)
FIGS. 1*a* and 1*b* represent a comparative example of the typical domain structure of an amorphous ribbon annealed according to the prior art in a saturating magnetic field across the ribbon width.

Amorphous metal alloys within the Fe—Co—Ni—Si—B system were prepared by rapidly quenching from the melt as thin ribbons typically 25 $\mu$m thick. Table I lists typical examples of the investigated compositions and their basic material parameters. All casts were prepared from ingots of at least 3 kg using commercially available raw materials. The ribbons used for the experiments were 6 mm wide and were either directly cast to their final width or slit from wider ribbons. The ribbons were strong, hard and ductile and had a shiny top surface and a somewhat less shiny bottom surface.

TABLE I

Examples of the investigated alloy compositions and their magnetic properties. $J_s$ the saturation magnetization, $\lambda_s$ the saturation magnetostriction constant and $T_c$ is the Curie temperature. The Curie temperature of alloys 8 and 9 is higher than crystallization temperature of these samples (≈440° C.) and, thus, could not be measured.

| Alloy | atomic constituents (at %) | | | | | magnetic properties | | |
|---|---|---|---|---|---|---|---|---|
| Nr | Fe | Co | Ni | Si | B | $J_s$ (Tesla) | $\lambda_s$ (ppm) | $T_c$ (° C.) |
| 1 | 24 | 30 | 26 | 8.5 | 11.5 | 0.99 | 13.0 | 470 |
| 2 | 24 | 18 | 40 | 2 | 16 | 0.95 | 11.7 | 415 |
| 3 | 24 | 16 | 43 | 1 | 16 | 0.93 | 11.1 | 410 |
| 4 | 22 | 15 | 45 | 2 | 16 | 0.87 | 10.1 | 400 |
| 5 | 32 | 10 | 40 | 2 | 16 | 1.02 | 16.7 | 420 |
| 6 | 37 | 5 | 40 | 2 | 16 | 1.07 | 18.7 | 425 |
| 7 | 40 | 2 | 40 | 5 | 13 | 1.03 | 18.9 | 400 |
| 8 | 37.5 | 15 | 30 | 1 | 16.5 | 1.23 | 22.1 | |
| 9 | 34 | 48 | — | 2 | 16 | 1.52 | 27.3 | |

Annealing

The ribbons were annealed in a continuous mode by transporting the alloy ribbon from one reel to another reel (or alternatively to the floor) through an oven in which a magnetic field of at least 500 Oe was applied to the ribbon. The direction of the magnetic field was always perpendicular to the long ribbon axis and its angle with the ribbon plane was varied from about 0° (transverse field-annealing), i.e. across the ribbon width, to about 90° (perpendicular field-annealing) i.e. substantially normal to the ribbon plane. The annealing was performed in ambient atmosphere.

The annealing temperature was varied from about 300° C. to about 420° C. A lower bound for the annealing temperature is about 250° C. which is necessary to relieve part of the production inherent stresses and to provide sufficient thermal energy in order to induce a magnetic anisotropy. An upper bound for the annealing temperature results from the Curie temperature and the crystallization temperature. Another upper bound for the annealing temperature results from the requirement that the ribbon is ductile enough after the heat treatment to be cut to short strips. The highest annealing temperature, preferably should be lower than the lowest of said material characteristic temperatures. Thus, typically, the upper bound of the annealing temperature is around 420° C.

The time during which the ribbon was subject to these temperatures was varied from a few seconds to about half a minute by changing the annealing speed. The latter ranged from about 0.5 m/min to 2 m/min in the present experiments where [we used] relatively short ovens were used with a hot zone of about 10–20 cm only. The annealing speed, however, can be significantly increased up to at least 20 m/min by increasing the oven length by e.g. 1 m to 2 m in length.

The ribbon was transported through the oven in a straight path and was supported by an elongated annealing fixture in order to avoid bending or twisting of the ribbon due to the forces and torques exerted on the ribbon by the magnetic field.

In one experimental set-up an electromagnet was used to produce the magnetic field for annealing. The pole shoes had a diameter of 100 mm and were separated at a distance of about 45 mm. In this way a homogenous field up to about 15 kOe could be produced on a length of about 70 mm. The furnace had a rectangular shape (length 230 mm, width: 45 mm, height: 70 mm). The heating wires were bifilarly wound in order to avoid magnetic fields produced by the heating current along the ribbon axis. The cylindrical annealing fixture (length: 300 mm, diameter: 15 mm) was made of stainless steel and had a rectangular slot (6×7 mm) in order to guide the ribbon. The homogenous temperature zone was about 100 mm. The oven was positioned in the magnet so that the applied magnetic field was perpendicular to the long axis of the annealing fixture and such that ribbon was cooled while still in the presence of the applied field. By turning the fixture around its long axis, the ribbon plane could be positioned at any angle with the applied magnetic field, which at the same time was perpendicular to the ribbon axis. With the help of this experimental set-up the influence of the strength and the angle of the applied annealing field on the magnetic and magnetoelastic properties were investigated.

In a second experimental set-up the magnetic field was produced by a yoke made of FeNdB magnets and magnetic iron steel. The yoke was about 400 mm long with an air-gap of about 100 mm. The field strength produced in the center of the yoke was about 2 kOe. The furnace, this time, was of cylindrical shape (diameter 110 mm, length 400 mm). A mineral insulated wire was used as the heating wire which again guaranteed the absence of an appreciable magnetic field produced by the heating current. The heating wire was wound on a length of 300 mm which gave a homogenous hot zone of about 200 mm. The annealing fixtures this time were of rectangular shape. Again, the oven was positioned in the magnet so that the applied magnetic field was perpendicular to the long axis of the annealing fixture and such that the ribbon was subjected to the magnetic field while it was hot. The annealing fixture again could be turned around its long axis, in order to position the ribbon at any angle relative to the applied magnetic field, which was perpendicular to the ribbon axis. This second set-up is more suitable for manufacturing than the electromagnet construction. In particular the homogenous field zone can be made much longer by an appropriately longer magnet yoke and can be up to several meters which allows the use of a longer furnace, and thus increases the speed of the annealing process considerably.

Testing

The annealed ribbon was cut to short pieces typically 38 mm long. These samples were used to measure the hysteresis loop and the magneto-elastic properties.

The hysteresis loop was measured at a frequency of 60 Hz in a sinusoidal field of about 30 Oe peak amplitude. The anisotropy field is the defined as the magnetic field $H_k$ at which the magnetization reached its saturation value (cf. FIG. 3*a*). For an easy axis across the ribbon width the transverse anisotropy field is related to anisotropy constant $K_u$ by $$H_k=2K_u/J_s$$

where $J_s$ is the saturation magnetization. $K_u$ is the energy needed per volume unit to turn the magnetization vector from the direction parallel to the magnetic easy axis to a direction perpendicular to the easy axis.

The magnetoresonant properties such as the resonant frequency $f_r$ and the resonant amplitude A1 were determined as a function of a superimposed dc bias field H along the ribbon axis by exciting longitudinal resonant vibrations with tone bursts of a small alternating magnetic field oscillating at the resonant frequency, with a peak amplitude of about 18 mOe. The on-time of the burst was about 1.6 ms with a pause of about 18ms between the bursts.

The resonant frequency of the longitudinal mechanical vibration of an elongated strip is given by $$f_r = \frac{1}{2L}\sqrt{E_H/\rho}$$

where L is the sample length, $E_H$ is Young's modulus at the bias field H and ρ is the mass density. For the 38 mm long samples the resonant frequency typically was between about 50 kHz and 60 kHz depending on the bias field strength.

The mechanical stress associated with the mechanical vibration, via magnetoelastic interaction, produces a periodic change of the magnetization J around its average value $J_H$ determined by the bias field H. The associated change of magnetic flux induces an electromagnetic force (emf) which was measured in a close-coupled pickup coil around the ribbon with about 100 turns.

In EAS systems the magnetoresonant response of the marker is detected between the tone bursts, which reduces the noise level, and thus for example allows for a wider gate. The signal decays exponentially after the excitation i.e. when the tone burst is over. The decay time, depends on the alloy composition and the heat treatment and may range from about a few hundred microseconds up to several milliseconds. A sufficiently long decay time of at least about 1 ms is important to provide sufficient signal identity between the tone bursts.

Therefore the induced resonant signal amplitude was measured about 1 ms after the excitation. This resonant signal amplitude will be referred to as A1 or A, respectively, in the following. A high A1 amplitude as measured here, thus, is both an indication of good magnetoresonant response and low signal attenuation at the same time.

For some characteristic samples the domain structure was also investigated with a Kerr microscope equipped with image processing and a solenoid with an opening for observation. The domains were typically observed on the shiny top surface of the ribbon.

Physical Background

Figure 1B:
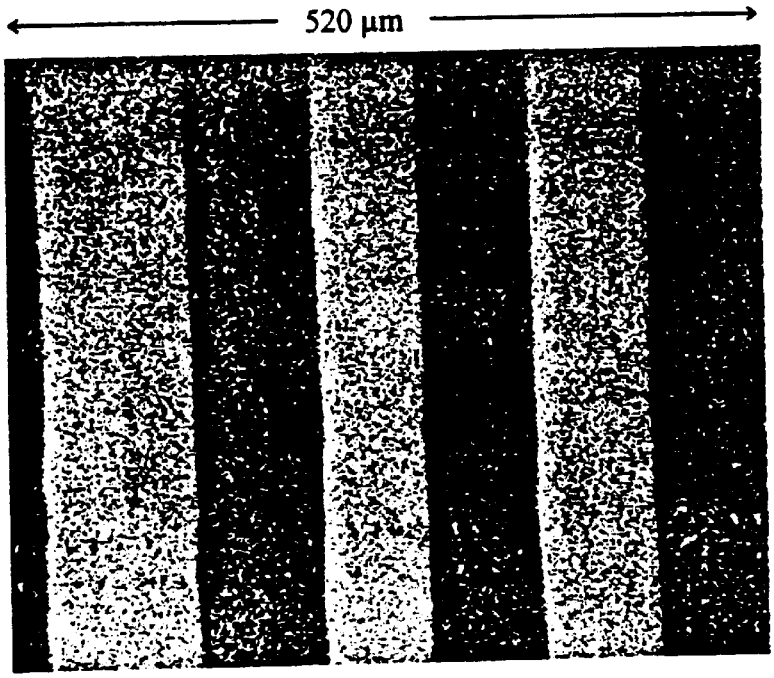
Fig. 1b (PRIOR ART)
Figure 2A:
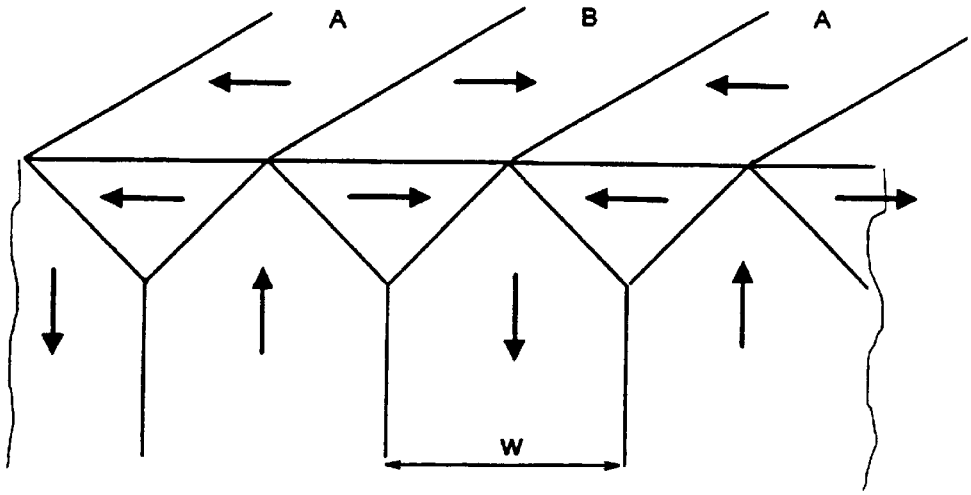
Fig. 2a (PRIOR ART)
FIG. 2*a* illustrates the typical domain structure of an amorphous ribbon annealed according to the prior art in a saturating magnetic field perpendicular to the ribbon plane.
Figure 2B:
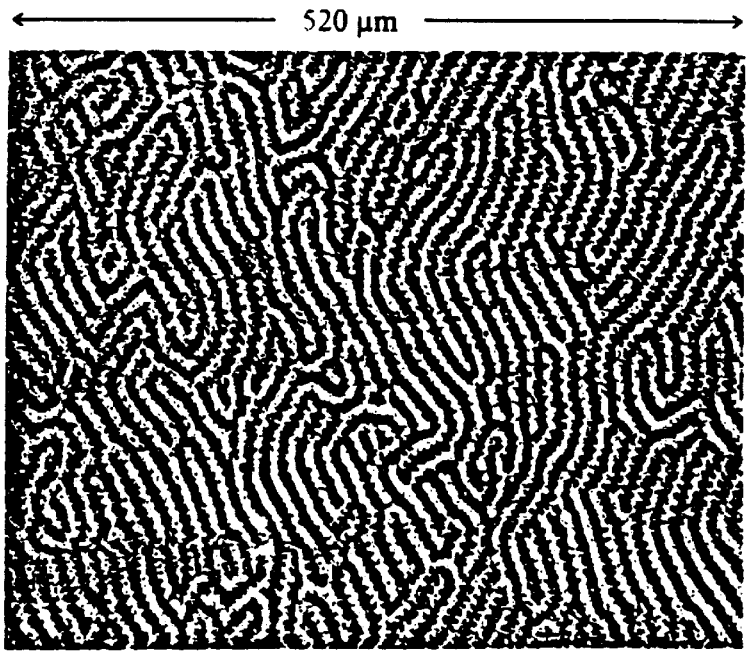
FIG. 2*b* is an experimental example of this domain structure for an amorphous $Fe_{24}Co_{18}Ni_{40}Si_2B16$ alloy annealed for about 6 s at 350° C. in a perpendicular field of about 10 kOe in accordance with the invention.

FIGS. 1*a* and 1*b* show the typical slab domain structures obtained after transverse field-annealing which yields a uniaxial anisotropy across the ribbon width. FIGS. 2*a* and 2*b* show the stripe domain structure with closure domains after annealing the same sample in a perpendicular field of 12 kOe, which yields a uniaxial anisotropy perpendicular to the ribbon plane. FIG. 2*a* shows this structure schematically (as is known) and FIG. 2*b* shows this structure for an inventive resonator alloy.

The domains are formed in order to reduce the magnetostatic stray field energy arising from the magnetic poles at the sample's surface. The thickness of an amorphous ribbon is typically in the order of 20–30 μm, and hence, much smaller than the ribbon width which typically is several millimeters or more. Accordingly, the demagnetizing factor perpendicular to the ribbon plane is much larger than across the ribbon width. As a consequence, when the magnetic easy axis is perpendicular to the ribbon plane, the larger demagnetization factor requires a much finer domain structures in order to reduce magnetostatic stray field energy, compared to an easy axis across the ribbon width. Thus the domain width for the case of the perpendicular anisotropy is much smaller, typically 10 μm or less, compared to the domain width of the transverse anisotropy, which typically is about 100 μm.

The domain width for these examples can be reasonably well described by (cf. Landau et al., in Electrodynamics of Continuous Media, Pergamon, Oxford, England, ch 7. (1981))

$$w = \sqrt{\frac{2\gamma_w D}{K_u}} \tag{1}$$

where $Y_w$ is the domain wall energy, $K_u = H_k J_s/2$ is the anisotropy constant and D is the dimension of the sample along which the magnetic easy axis is oriented. That is, D equals the ribbon width for an in-plane transverse anisotropy, while for a magnetic easy axis normal to the ribbon plane D corresponds to the ribbon thickness.

Figure 3A:
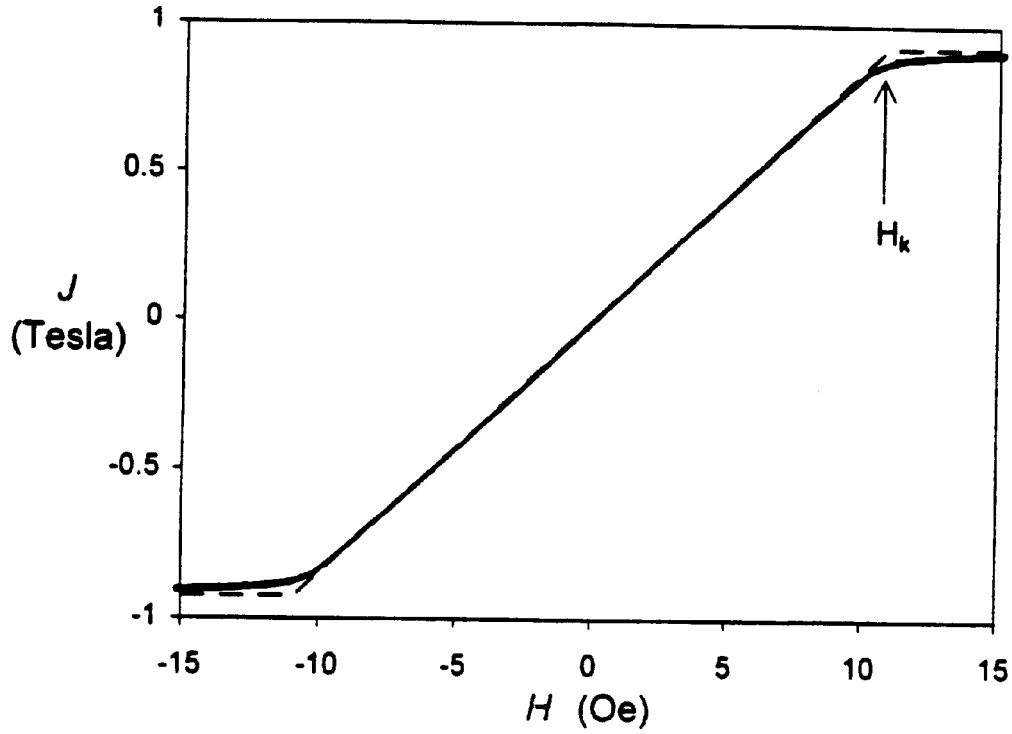
FIGS. 3*a* and 3*b* show the typical hysteresis loops as obtained after (a) transverse field annealing in a magnetic field of about 2 kOe and (b) after perpendicular field-annealing in a field of about 15 kOe, respectively; both loops were recorded on a 38 mm long, 6 mm wide and appr. 25 $\mu$m thick sample; the dashed lines in each case are the idealized, linear loops and serve to demonstrate the linearity and the definition of the anisotropy field $H_k$.; the particular sample shown in the figure is an amorphous $Fe_{24}Co_{18}Ni_{40}Si_2B_{16}$ alloy annealed for about 6 s at 350° C. in each case.
Figure 3B:
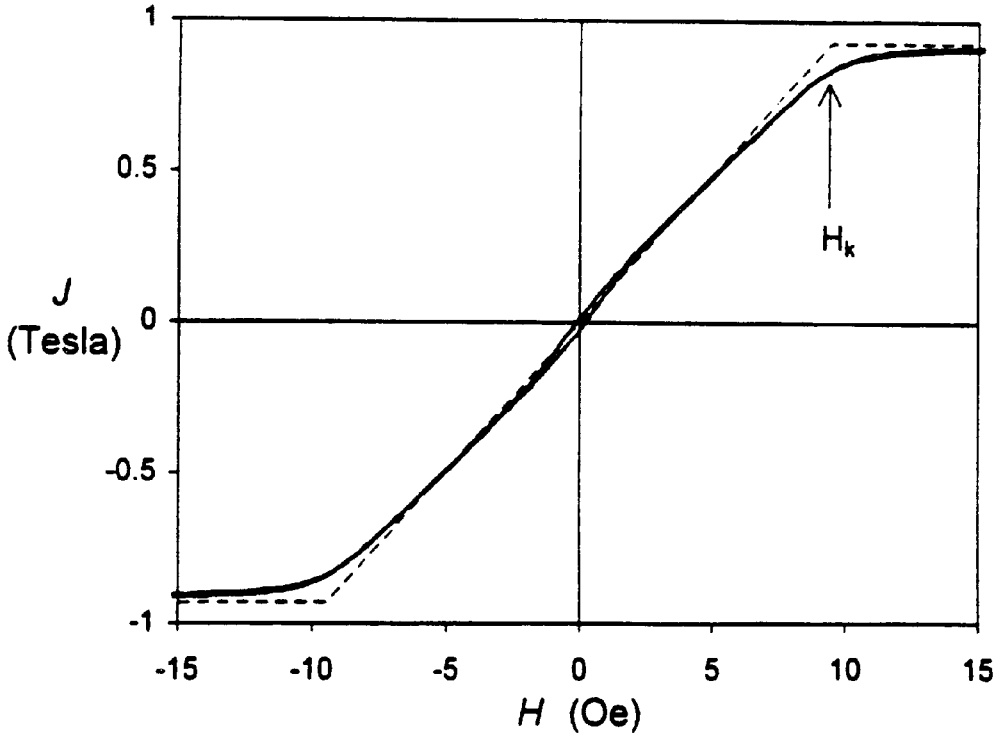

FIGS. 3*a* and 3*b* compare the hysteresis loops associated with the domain structures shown in FIGS. 1*a* and 1*b* and 2*a* and 2*b*. The loop obtained after transverse field-annealing is shown in FIG. 3*a* and shows a linear behavior up to the field $H_k$ where the sample becomes ferromagnetically saturated. The loop obtained after perpendicular field annealing is shown in FIG. 3*b* and also shows a substantially linear behavior. Yet, there is still a small non-linearity obvious at the opening in the center at H=0. This non-linearity is much less pronounced than in materials of the prior art used for EAS applications in the as prepared state. Nonetheless it may still produce harmonics when excited by an AC-magnetic field and thus may produce undesirable alarms in other types of EAS systems.

The difference in domain size for the two different orientation of the magnetic easy axis is most obvious and has been independently confirmed in many experiments as described earlier. It is also well known that eddy current losses can be reduced by domain refinement. Yet conventionally it has been believed that this loss reduction by domain refinement applies only if the magnetization process is governed by domain wall displacement. In the present case, however, the magnetization is primarily controlled by the rotation of the magnetization vector toward the magnetic field applied along the ribbon axis. Thus, from the basic mechanisms relevant to eddy current losses, the two cases have been looked upon as equivalent, as evidenced by the aforementioned Mermelstein article. In practice, however, the losses of the perpendicular field-annealed samples are often reported to be larger than for transverse field annealed samples, which is associated with additional hysteresis losses due to the non-linear opening in the center of the hysteresis loop. The latter is related to irreversible magnetization processes within the closure domains associated e.g. with the irregular "labyrinth" domain pattern.

By contrast, the present invention proceeds from the recognition that, despite the aforementioned commonly held opinion, the refined domain structure as exhibited in the perpendicular field-annealed samples can be advantageous with respect to lower losses and better magentoresonant behavior. This is particularly true if the situation is considered where the strip is biased by a static magnetic field along the ribbon direction when being excited by an AC magnetic field along the same direction. This is precisely the situation in activated magnetoelastic markers used in EAS-systems or, for example, in an inverter transformer in ISDN applications.

The physical mechanisms for this improvement can be derived from an earlier observation of the present inventor made for transverse field-annealed samples (Herzer G., "Magnetomechanical damping in amorphous ribbons with uniaxial anisotropy", Materials Science and Engineering vol. A226–228, p. 631–635 (1997)). Accordingly the eddy current losses in an amorphous ribbon with transversely induced anisotropy do not follow the classical expression $$P_e^{class} = \frac{(tpfB)^2}{6\rho_{el}} \tag{2a}$$

as commonly believed hitherto, but instead have to be described by $$P_e = \frac{P_e^{class}}{1-(J_x/J_s)^2} \tag{2b}$$

where t denotes the ribbon thickness, f is the frequency, B is the ac induction amplitude, $P_{ei}$ is the electrical resistivity, $J_x$ is the component of the magnetization vector along the ribbon axis due to the static magnetic bias field, and $J_s$ is the saturation magnetization.

Since for non-zero bias fields (i.e. $J_x>0$) the denominator in eq. (2b) is smaller than one, the losses described by this equation are larger than the classical eddy current losses $P_e^{class}$, in particular when the magnetization along the ribbon direction approaches saturation, i.e. $J_x \approx J_s$. Only at zero static magnetic field, where loss measurements are usually being performed, both models yield the same result. The latter may be the reason why so far the disadvantageous excess eddy currents associated with the transverse anisotropy have not been appreciated.

The denominator in eq. (2b) is related to the fact that in materials with uniaxial anisotropy perpendicular to the direction of the applied magnetic field, the magnetization process is dominated by the rotation of the magnetization vector. Thus, within a domain, a change of magnetization along the ribbon direction is inevitably accompanied by change of magnetization perpendicular to this direction. The latter produces excess eddy current losses which become increasingly important the more the equilibrium position of the magnetization vector is declined towards the ribbon axis by the static bias field.

Figure 4:
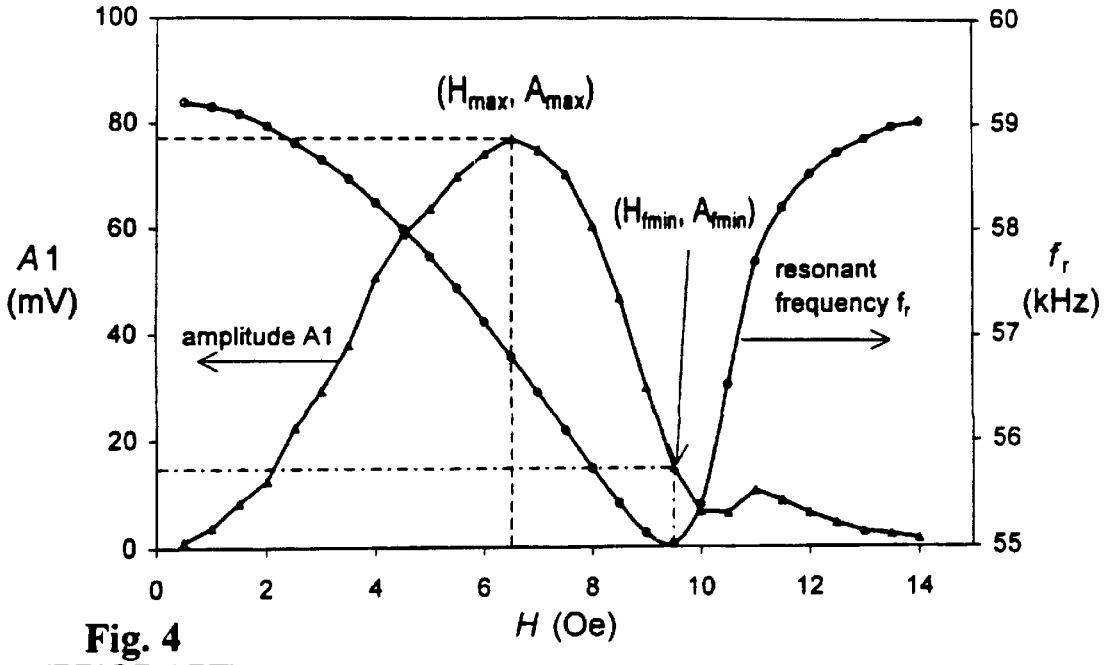
Fig. 4 (PRIOR ART)
FIG. 4 is a comparative example according to the prior art for the typical behavior of the resonant frequency $f_r$ and the resonant amplitude A1 as a function of a static magnetic bias field H for an amorphous magnetostrictive ribbon annealed in a saturating magnetic field across the ribbon width; the particular example given here corresponds to a 38 mm long, 6 mm wide and appr. 25 $\mu$m thick strip of an amorphous $Fe_{24}Co_{18}Ni_{40}Si_2B_{16}$ alloy annealed for about 6 s at 350° C. in a transverse field of about 2 kOe.

As described in the aforementioned Herzer article, one consequence of these excess losses is that the magnetomechanical damping is significantly larger than expected by conventional theories (cf. Bozorth, Ferromagnetism (d. van Nostrand Company, Princeton, N.J.) ch. 13, p 684 ff (1951)). The consequences are illustrated in FIG. 4 which shows the resonant frequency $f_r$ and the resonant signal amplitude $A_1$ of an amorphous strip annealed according to the prior art in a transverse field across the ribbon width. The resonant signal amplitude decreases significantly when the applied field exceeds about half the anisotropy field $H_k$ and there is no appreciable signal left where the resonant frequency runs through a minimum which is the case at a bias field close to the anisotropy field.

As a conclusion it should be noted that the excess eddy currents related to the transverse anisotropy severely restrict the effective resonant susceptibility which otherwise would be obtainable in a hypothetical, isotropic material.

Physical Principles and Examples of the Invention

The inventor has recognized that in order to describe the aforementioned damping mechanism correctly, it had to be assumed that the domain size is much larger than the ribbon thickness, which obviously is the case in the transverse field-annealed samples.

Rejecting this assumption, the inventor has found that in the case of an arbitrary domain size a more correct description of the eddy current losses would be $$P_e = P_e^{class}\left[1-\varepsilon+\frac{\varepsilon}{1-(J_x/J_s)^2}\right] \tag{3a}$$

with $$\varepsilon \approx \frac{w^2}{(w\cdot\cos\beta+t)^2} \tag{3b}$$

where $P_e^{class}$ are the classical eddy current losses defined in eq. (2a), w is the domain width, t is the ribbon thickness and β is the angle between the magnetic easy axis and the ribbon plane (i.e. β=0 for a transverse anisotropy and β=90° for a perpendicular anisotropy).

For β=0 and w>>t, i.e. for a transverse anisotropy we have ε≈1 and we end up with the enhanced eddy current losses of eq. 2b.

For very small domains, i.e. w<<t, however, ε≈0. Thus, in this case, the losses are described by the classical eddy current loss expression (eq. (2a)), and hence in the presence of a bias field, would be much smaller than losses in a transversely field annealed sample.

Perpendicular Anisotropy

According to these new, surprising theoretical results the perpendicular field annealed material with its finer domain structure seems to be much more attractive for magnetoelastic applications in terms of lower eddy current damping, and hence higher resonant susceptibility.

Figure 5:
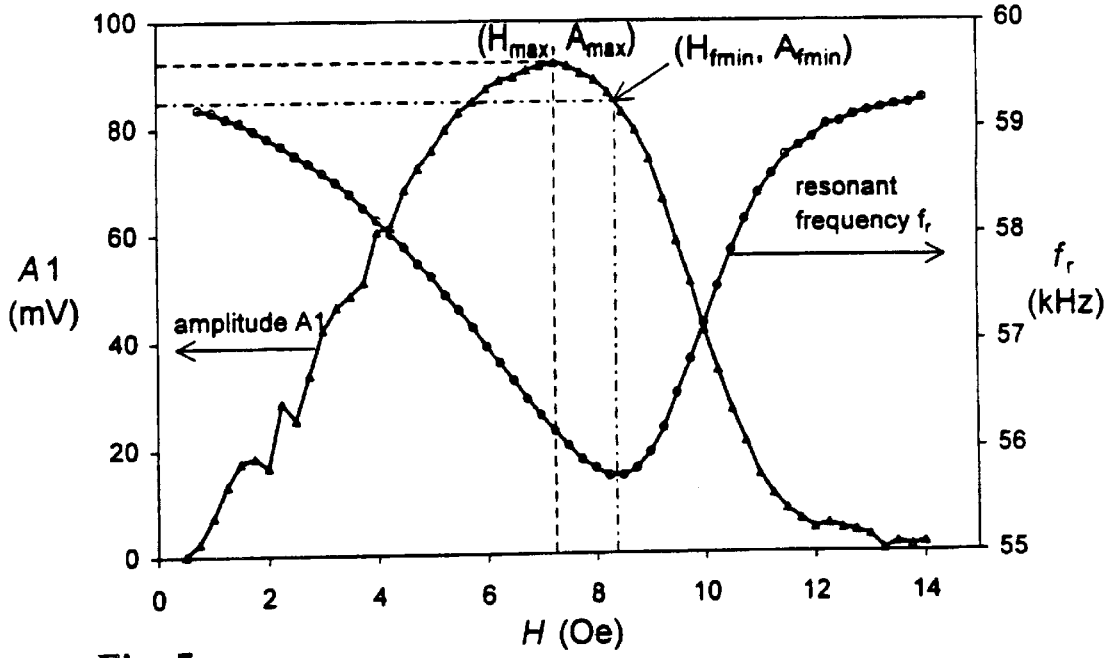
FIG. 5 is an inventive example for the typical behavior of the resonant frequency $f_r$ and the resonant amplitude A1 as a function of a static magnetic bias field H for an amorphous magnetostrictive ribbon using a heat treatment of the prior art by applying a saturating magnetic field perpendicular to the ribbon plane during the heat treatment; the particular example given here corresponds to a 38 mm long, 6 mm wide and appr. 25 $\mu$m thick strip cut from an amorphous $Fe_{24}Co_{18}Ni_{40}Si_2B_{16}$ alloy annealed about 6 s at 350° C. in a perpendicular field of about 15 kOe.

Consistent with this theory, samples were annealed accordingly and their magnetoelastic properties were investigated. FIG. 5 is a typical result for the resonant frequency and the resonant amplitude of such a perpendicularly field-annealed specimen. The result shown was obtained with the same alloy ($Fe_{24}Co_{18}Ni_{40}Si_2B_{16}$) and with the same thermal conditions (i.e. annealing time 6s, annealing temperature 350° C.) as used for the example shown in FIG. 4. Instead of the usual transverse field of about 2 kOe a strong magnetic annealing field of about 15 kOe oriented perpendicular to the ribbon plane was employed.

The comparison of FIGS. 4 and 5 shows that although the resonant frequency $f_r$ of both samples behaves in a most comparable way, the perpendicular annealed sample reveals a much higher amplitude than the transverse annealed sample over a wide range of bias fields. In particular the signal amplitude is still close to its maximum value at the bias field where $f_r$ is minimum. The latter is an important aspect for the application in markers for EAS systems since the resonant frequency is a fingerprint of the marker. The resonant frequency is usually subject to changes due to changes in the bias field H associated with the earth's magnetic field and/or due to scatter of the properties of the bias magnet strips. It is obvious that these deviations in $f_r$ are minimized if the operating bias is chosen to be close to the field where $f_r$ reveals its minimum. Apart from this benefit, it is also obvious that the generally higher signal amplitude of the perpendicular annealed sample is of benefit for improving the pickup (detection) rate of a marker in an EAS system.

It should be noted that the improvement of the magnetoresonant properties is primarily related to the perpendicular anisotropy and not necessarily the technique of how this anisotropy was achieved. Another way of generating such an anisotropy is e.g. by partial crystallization of the surface (cf. Herzer et al. "Surface Crystallization and Magnetic Properties in Amorphous Iron Rich Alloys", J. Magn. Magn. Mat., vol. 62, p. 143–151 (1986)). Thus a first embodiment of the invention relates to the improvement of the eddy current losses and/or magnetoresonant properties by establishing a perpendicular anisotropy instead of a transverse one. It is still important to recognize that one important characteristics of such a perpendicular anisotropy is that the magnetic and magneto-elastic properties are isotropic within the ribbon plane. Thus, unlike a marker or sensor having a transverse anisotropy component, the performance of a marker or sensor using a sample with "pure" perpendicular anisotropy, if of near circular or quadratic shape, is less sensitive to the orientation with respect to the applied magnetic fields. Hence, an article surveillance system incorporating such a new type of a "circular" marker made of an amorphous strip with perpendicular anisotropy should reveal an even higher detection sensitivity. Nonetheless, in what follows, an elongated strip operated along its long axis is specifically discussed. The hysteresis loop of the perpendicularly field-annealed sample reveals a substantially linear characteristic and, thus, when excited by a magnetic ac-field generates less harmonics than the non-linear hysteresis loop characteristic for the as prepared state. As mentioned above, however, there is still a small non-linearity in the center of the loop associated with the irregular "labyrinth" domain pattern which may be disadvantageous if non-interference with harmonic EAS system is a strict requirement. This non-linearity is also a deficiency if the perpendicular anisotropy is established by the aforementioned crystallization of the surface.

The insight in order to overcome this remaining deficiency is to recall that this non-linearity is related to the irregular domain pattern found for the perpendicular annealed sample. Thus, Grimm et al., "Minimization of Eddy Current Losses in Metallic Glasses by Magnetic Field Heat Treatment", Proceedings of the SMM 7 conference in Blackpool (Wolfson Centre for Magnetics Technology, Cardiff) p. 332–336 (1985) teaches that one way of removing this non-linearity is to choose a sample with high magnetostriction. Hubert et al., found, that magnetostrictive interactions favor the closure domains oriented perpendicular to the applied field, which results in a less complex magnetization process within the closure domains, and hence in a hysteresis loop without the non-linear center region. Indeed when performing the reported experiment with an amorphous $Fe_{53}Ni_{30}Si_1B_{16}$ alloy whose saturation magnetostriction was about $\lambda_s \approx 29$ ppm, i.e. considerably higher than that of the $Fe_{24}Co_{18}Ni_{40}Si_2B_{16}$ alloy ($\lambda_s \approx 12$ ppm) the non-linear portion of the hysteresis loop could be removed. The $Fe_{53}Ni_{30}Si_1B_{16}$ alloy, however, exhibited a much more sensitive dependence of the resonant frequency as a function of the applied bias field than the $Fe_{24}Co_{18}Ni_{40}Si_2B_{16}$ alloy, although the induced anisotropy field was virtually the same. Thus at a bias field of 6 Oe for example, the slope of the resonant frequency $|df_r/dH|$ was about 1700 Hz/Oe for the $Fe_{53}Ni_{30}Si_1B_{16}$ alloy while the $Fe_{24}Co_{18}Ni_{40}Si_2B_{16}$ alloy revealed a slope of only about 600 Hz/Oe. Although the high sensitivity of the resonant frequency on the bias may be advantageous for surveillance systems which is designed to make use of this property, it is clearly disadvantageous for known systems on the market which use the precise value of the resonance frequency at a given bias to provide the marker with identity. Thus, the proposed way of linearizing the loop by choosing a highly magnetostrictive alloy is less suited for the latter kind of EAS systems.

Accordingly, an investigation was made for more suitable ways to remove the aforementioned non-linearity of the hysteresis loop and simultaneously maintain the enhanced magnetoresonant susceptibility associated with the refined domain structure. First, it was recognized that this objective might be achieved by establishing a magnetic easy axis which is still oriented perpendicular to ribbon axis but obliquely to the ribbon plane i.e. at an angle between 0° (transverse direction) and 90° (perpendicular direction). Second, a field annealing technique had to be devised which achieves such an oblique anisotropy. For this purpose it was necessary to abandon the established practices of the prior art, which essentially teaches to apply a magnetic field during annealing either across the ribbon width or normal to the ribbon plane strong enough to saturate the sample ferromagnetically in the corresponding direction.

Oblique Anisotropies

Figure 6A:
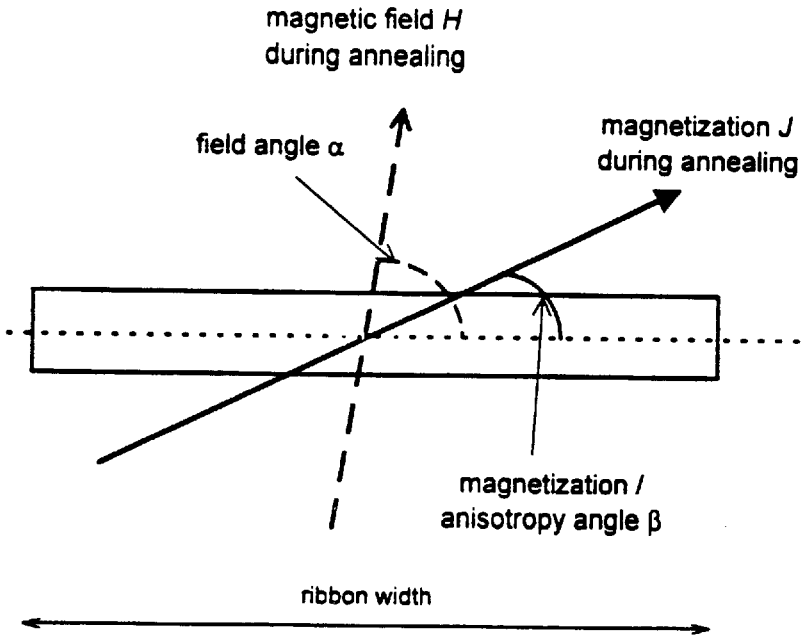
FIGS. 6*a* and 6*b* illustrate the principles of the field annealing technique according to this invention.
Figure 6B:
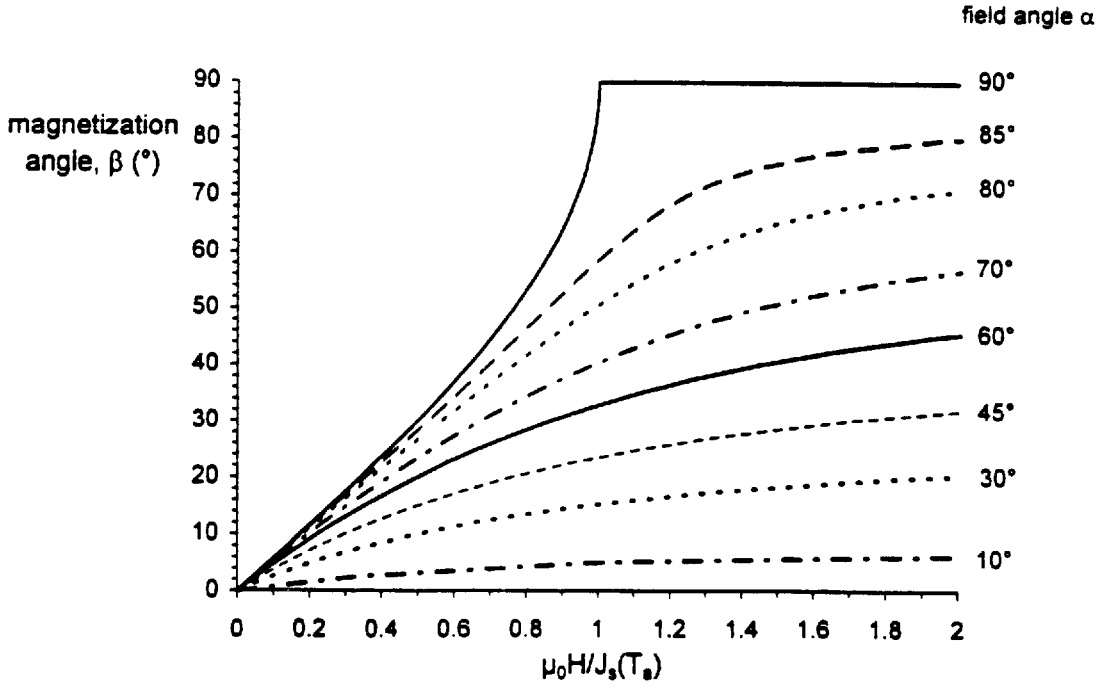

FIGS. 6*a* and 6*b* illustrate the basic principles of the field annealing technique according to this invention. FIG. 6*a* is a schematic illustration of the ribbon's cross section and illustrates the orientation of the magnetic field applied during annealing and the resulting orientation of the magnetization vector during annealing.

Unlike the teachings of the prior art it was not necessarily attempted to make the applied magnetic field strong enough to orient the magnetization vector along its direction, but instead the magnetic field vector and the magnetization vector were applied at respectively different points along different directions during annealing.

The orientation of the magnetization vector depends upon the strength and orientation of the applied field. It is mainly determined by the balance of the magnetostatic energy gained if the magnetization aligns parallel to the applied field and the magnetostatic strayfield energy which is necessary to orient the magnetization out of the plane due to the large demagnetization factor normal to the plane. The total energy per unit volume can be expressed as $$\varphi = -HCDOTJ_s(T_a)\cdot(\sin\alpha\sin\beta + \cos\alpha\cos\beta) + \frac{J_s(T_a)^2}{2\mu_0}(N_{zz}\sin^2\beta + N_{yy}\cos^2\beta) \quad (4)$$

where H is the strength and a is the out-of-plane angle of the magnetic field applied during annealing, $J_s(T_a)$ is the spontaneous magnetization at the annealing temperature $T_a$, β is the out-of-plane angle of the magnetization vector, $\mu_0$ is the vacuum permeability, $N_{zz}$ is the demagnetizing factor normal to the ribbon plane and $N_{yy}$ is the demagnetizing across the ribbon width. The angles α and β are measured with respect to a line across the ribbon width and a line parallel to the direction of the magnetic field and magnetization (or anisotropy direction), respectively. Numerical values given for α a and β refer to the smallest angle between said directions. That is e.g. the following angles are equivalent 85°,95°(=180°−85°) and/or 355°. Furthermore, the magnetic field and/or the magnetization shall nominally have no appreciable vector component along the ribbon axis. The ribbon or strip axis means the direction along which the properties are measured i.e. along which the bias field or the exciting ac-field is essentially acting. This is preferably the longer axis of the strip. Accordingly, across the ribbon width means a direction perpendicular to the ribbon axis. Principally, elongated strips can be also prepared by slitting or punching the strip out of a wider ribbon, where the long strip axis is at an arbitrary direction with respect to the axis defined by the original casting direction. In the latter case, "ribbon axis" refers to the long strip axis and not necessarily to the casting direction i.e. the axis of the wide ribbon. Although in the present examples the strip or ribbon axis is parallel to the casting direction, aforementioned or similar modifications will be clear to those skilled in the art.

The angle β at which the magnetization vector comes to lie can be obtained by minimizing this energy expression with respect to β. The result obtained by numerical methods is given in FIG. 6*b* for a 25 μm thick amorphous ribbon. In case of the field being applied perpendicular the result can be analytically expressed as:

$$\beta = \begin{cases} \arcsin & \text{for } \mu_0 H < J_s(T_a) \\ 90° & \mu_0 H \geq J_s(T_a) \end{cases} \quad (5)$$

recognizing that $N_{yy} << N_{zz} \approx 1$.

It should be noted that small corrections may be necessary to this model due to internal anisotropies e.g. due to magnetostrictive interaction with internal mechanical stresses. Yet the internal magnetic fields necessary to overcome these intrinsic anisotropies are much smaller than the demagnetizing effects which are dominating in the situation sketched in FIG. 6*b*.

For the thin amorphous ribbon, the demagnetizing factor across the ribbon width is only about $N_{yy}$0.004 (cf. Osborne, "Demagnetizing Factors of the General Ellipsoid", Physical Review B 67 (1945) 351 (1945)). That is, the demagnetizing field across the ribbon width is only 0.004 times the saturation magnetization in Gauss when the ribbon is fully magnetized in this direction. Accordingly an alloy with a saturation magnetization of 1 Tesla (10 kG), for example, can be homogeneously magnetized across the ribbon width if the externally applied field exceeds about 40 Oe. The demagnetizing factor perpendicular to the ribbon, however, is close to unity, i.e. in a very good approximation can be put as $N_{zz}$=1. That is, when magnetized perpendicular to the ribbon plane the demagnetizing field in that direction virtually equals the saturation magnetization in Gauss. Accordingly a field of about 10 kOe is needed, for example, in order to orient the magnetization perpendicular to the ribbon plane if the saturation magnetization is 1 Tesla (10 kG).

Figure 7:
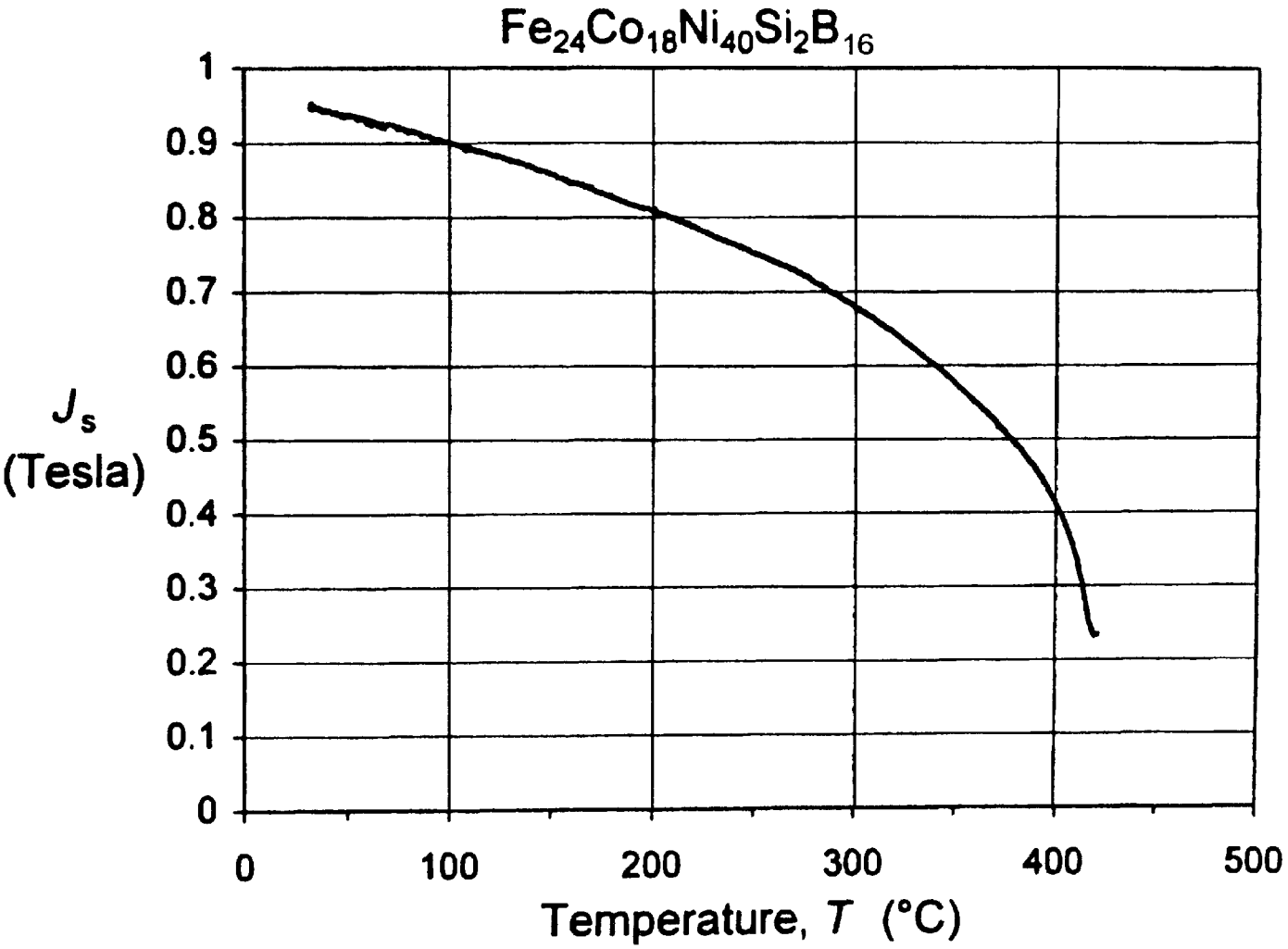
FIG. 7 shows the temperature dependence of the saturation magnetization $J_s$ of an amorphous $Fe_{24}Co_{18}Ni_{40}Si_2B_{16}$ alloy.

FIG. 6*b* shows the calculated angle of the magnetization vector during annealing as a function of the strength and orientation of the applied annealing field. The field strength H is normalized to the saturation magnetization $J_s(T_a)$ at the annealing temperature. FIG. 7 shows, as an example, the temperature dependence of the saturation magnetization for the investigated $Fe_{24}Co_{18}Ni_{40}Si_2B_{16}$ alloy. Compared to its room temperature value of $J_s$=0.95 T, the magnetization is reduced e.g. to about $J_s$=0.6 T at an annealing temperature of about 350°. The latter value is ultimately relevant to the aforementioned demagnetizing fields during annealing.

It is now important to note that the magnetic easy axis induced during annealing is not parallel to the applied field, but is parallel to the direction of the magnetization vector during annealing. That is, the magnetization angle β as shown in FIG. 6 corresponds to the angle of the induced anisotropy axis after annealing.

Figure 8A:
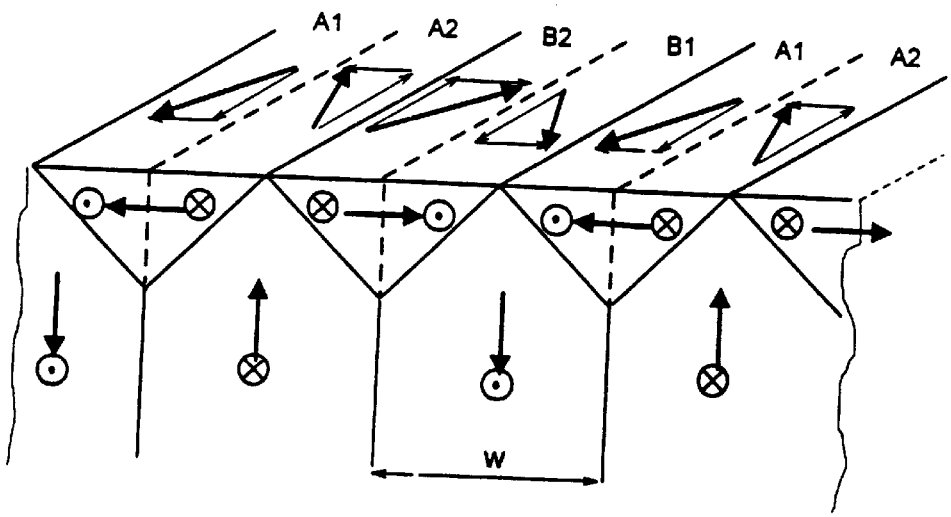
FIGS. 8*a* and 8*b* show an example for the domain structure of an amorphous ribbon field-annealed according to this invention which yields a uniaxial anisotropy oriented perpendicular to the ribbon axis and oblique to the normal of the ribbon plane.

FIG. 8 illustrates the domain structure which is obtained for such an oblique anisotropy axis. FIG. 8*a* is a schematic sketch as expected from micromagnetic considerations. Similar to the case of the perpendicular anisotropy, closure domains are being formed in order to reduce the magnetostatic energy arising from the perpendicular component of the magnetization vector. For small out-of-plane angles the closure domains may be absent, but in any case the domain width is reduced in order to reduce magnetostatic stray field energy.

Figure 8B:
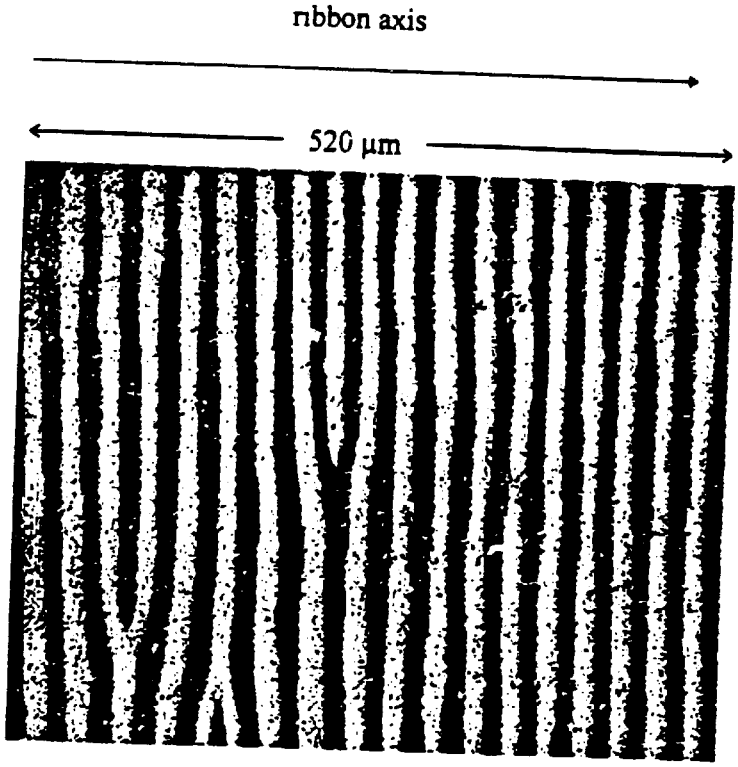

The particular example shown in FIG. 8*b* is for an $Fe_{24}Co_{18}Ni_{40}Si_2B_{16}$ alloy annealed for about 6 seconds at a temperature of 350° C. in a field of 3 kOe oriented at about α=88° with respect to the ribbon plane. Very fine domains of about 12 μm in width are observed, i.e. considerably smaller than the slab domains of the transverse field annealed sample (cf. FIG. 1). The magneto-optical contrast seen in FIG. 6*b* corresponds to the closure domains A and B in FIG. 8*a*, respectively. In contrast to the "labyrinth" domain pattern observed for the sample annealed in a 10 kOe perpendicular field (cf. FIG. 2*b*) the domains are now regularly oriented across the ribbon width.

The applied field strength of 3 kOe is about half the magnetization in Gauss at the annealing temperature $T_a$ ($J_s$(360° C.)≈0.6 Tesla=6 kG) i.e. $U_0H/J_s(T_a)$ 0.5. Accordingly (cf. FIG. 6*b*) the out-of-plane angle of the induced anisotropy can be estimated to be about 30°.

Figure 9A:
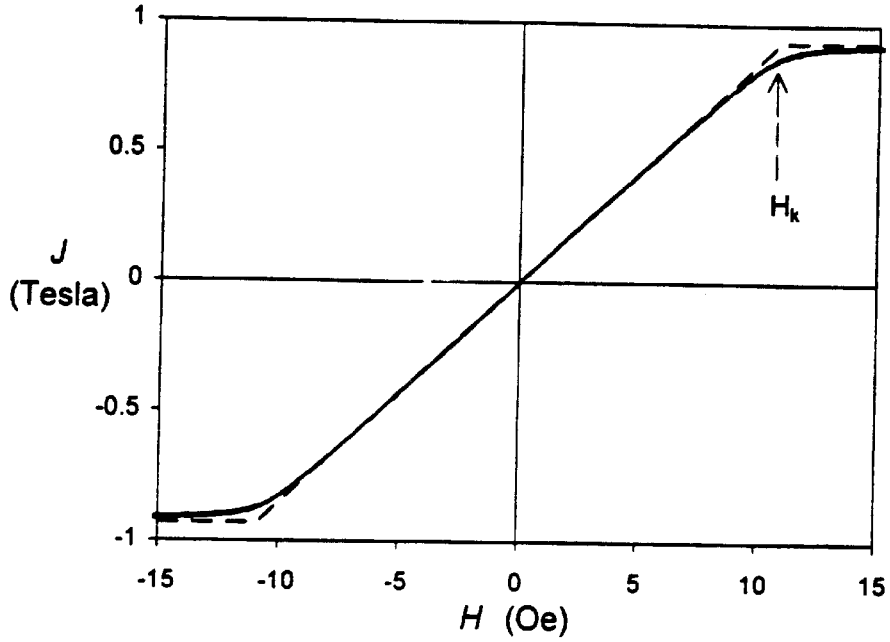
FIGS. 9*a* and 9*b* show an inventive example for the (a) magnetic and (b) magnetoresonant properties of a magnetostrictive amorphous alloy when annealed according to the principles of this invention.
Figure 9B:
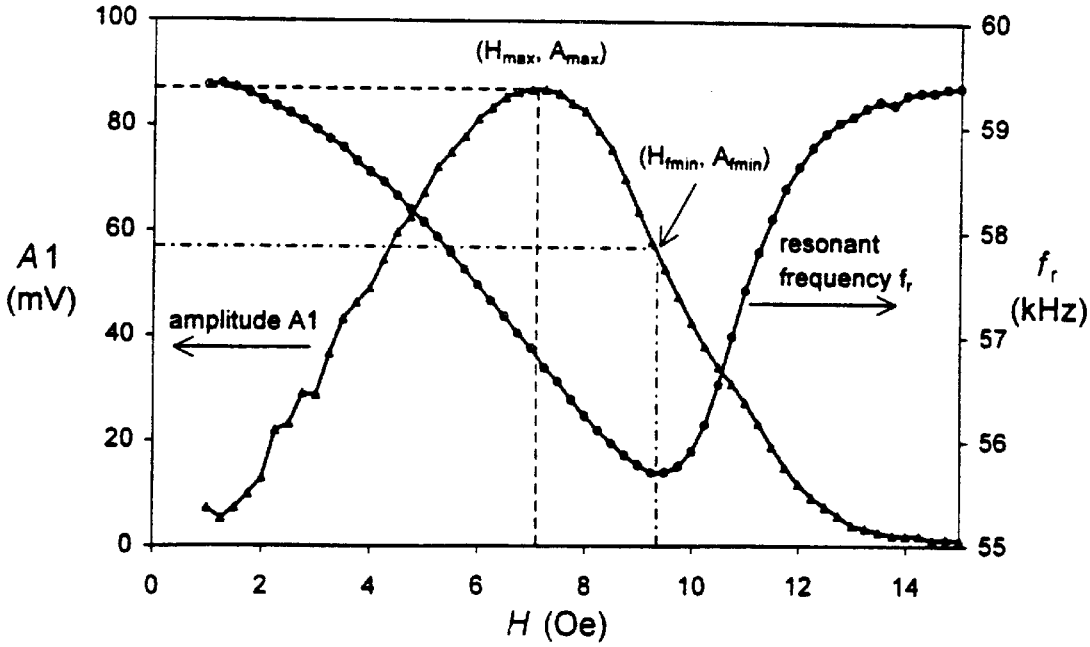

FIG. 9 shows the hysteresis loop and the magneto-resonant behavior of a similarly annealed sample. As can be seen from FIG. 9*a* the non-linear opening in the central part, as was present for the case of the perpendicular anisotropy (cf. FIG. 3*b*), has disappeared now and the loop is as linear as in the case of the transversely field-annealed sample (cf. FIG. 3*a*). The resonant signal amplitude, although somewhat smaller than in the perpendicular case (cf. FIG. 5), is clearly larger than for the transverse field annealed sample (cf. FIG. 4) in a wide range of bias fields.

Figure 10:
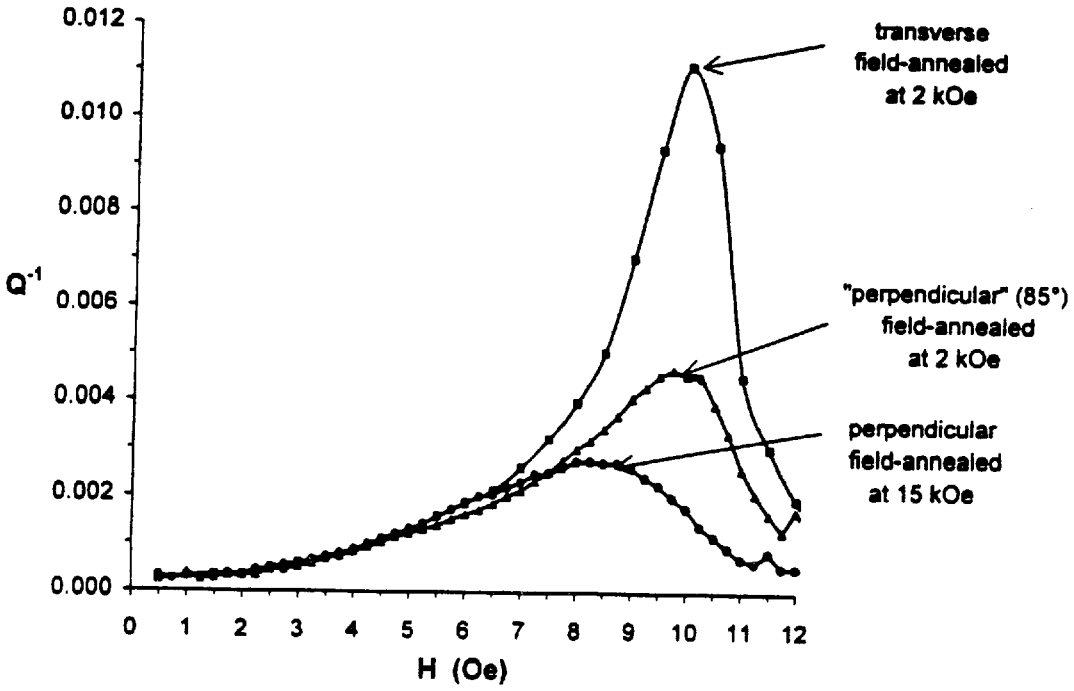
FIG. 10 compares the typical behavior of the damping factor $Q^{-1}$ as a function of a static magnetic bias field as obtained by the field annealing techniques according to the prior art and according to this invention, respectively; the particular example is an amorphous $Fe_{24}Co_{18}Ni_{40}Si_2B_{16}$ alloy annealed in a continues mode for about 6 s at 350° C.–360° C. in a magnetic field.

FIG. 10 compares the magneto-mechanical damping factor $Q^{-1}$ of the differently field annealed samples. FIG. 10 clearly reveals that owing to its fine domain structure and similar to the perpendicular anisotropy, the oblique anisotropy leads to a significantly lower magneto-mechanical damping than in the case of the transverse anisotropy. This observation is consistent with the findings for the signal amplitude.

Influence of the annealing field strength

In order to verify the findings in more detail, a first set of experiments investigated the influence of the annealing field strength. The annealing field was oriented substantially perpendicular to the ribbon plane i.e. at an angle close to 90° (see also next section). The results are shown in FIGS. 11*a*, 11*b* and 11*c*, and 12*a* and 12*b*.

Figure 11A:
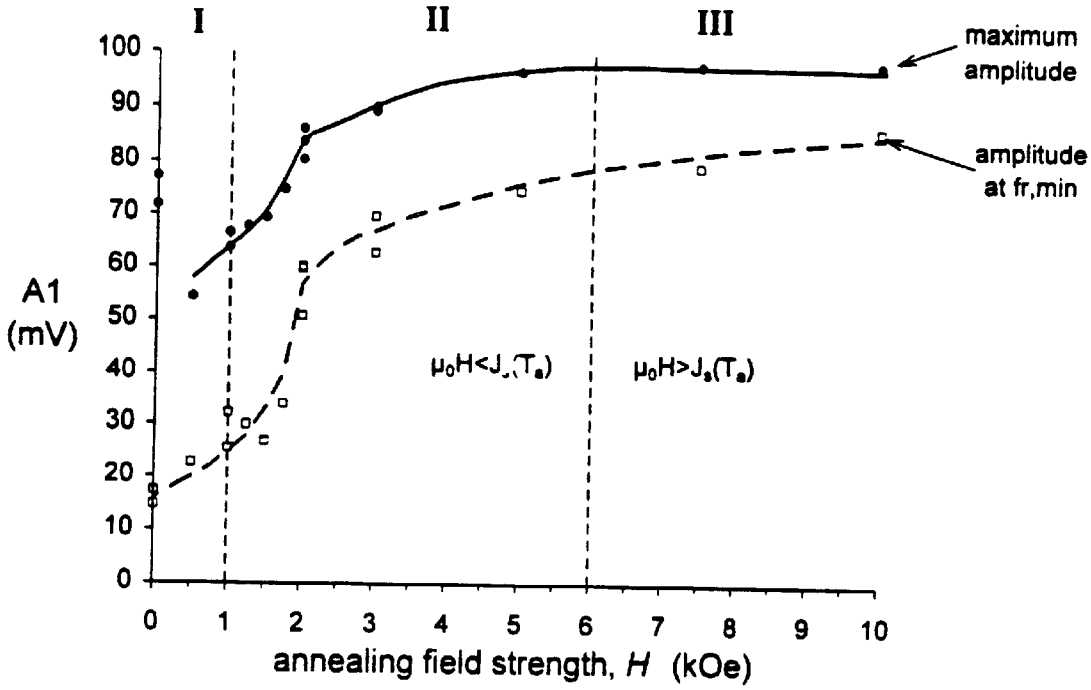
FIGS. 11*a*, 11*b* and 11*c* demonstrate the effect of the strength of the magnetic field strength H applied during annealing on (a) the resonant signal amplitude, (b) the domain structure and (c) on the anisotropy field $H_k$; the annealing field was acting essentially normal to the ribbon plane i.e. at an angle between about 85° and 90° except for the data points given at H=0 where a 2 kOe field was applied across the ribbon width.
Figure 11B:
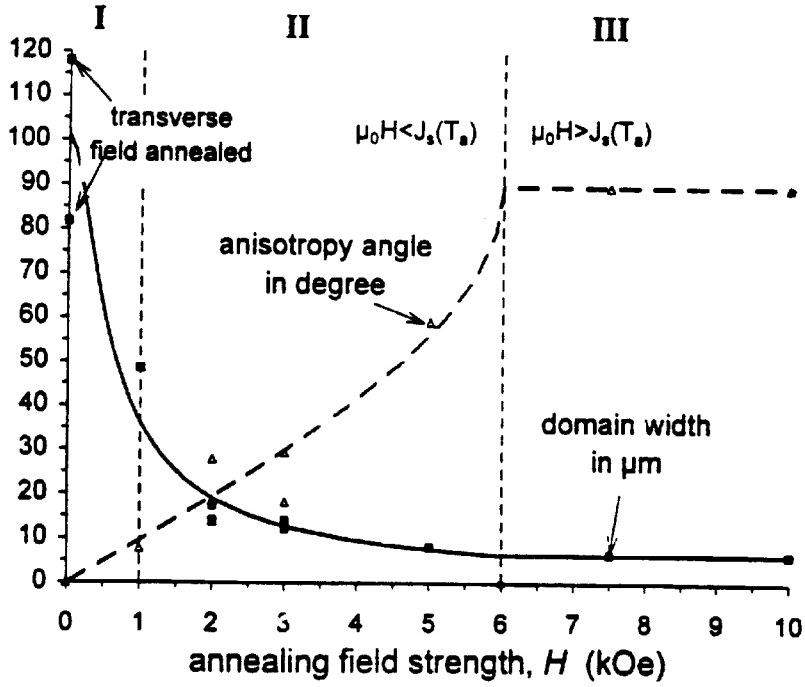

FIG. 11*a* shows the influence of the annealing field strength on the resonant amplitude. FIG. 11*b* shows the corresponding variation of the domain size and the anisotropy angle β with respect to the ribbon plane.

The domain sizes steeply decreases from about 100 μm for the transversely annealed sample (shown at H=0) to values in the order of the ribbon thickness as the perpendicular annealing field strength is increased above about 1.0 kOe i.e. about one sixth of the saturation magnetization at the annealing temperature. Interestingly this decrease in domain size requires only a relatively small out-of-plane component of the magnetic easy axis. As already described this domain refinement reduces the magnetostatic stray field energy induced by the out-of-plane component of the magnetization vector which tends to be along the magnetic easy axis.

The reduction of magnetostatic stray field energy is counterbalanced by the energy needed to form domain walls and eventually to form the closure domains. By balancing these energy contributions (cf. Kittel C., "Physical Theory of Ferromagnetic Domains", Rev. Mod. Phys. vol. 21, p.

541–583 (1949)) the domain wall width w of the inventive material can be estimated as $$w \approx \sqrt{\frac{2\gamma_w t}{K_u \cdot (N_{zz}\sin^2\beta + N_{xx}\cos^2\beta)}} \tag{6}$$

where $Y_w$ is the domain wall energy, t is the ribbon thickness, $K_u = H_k J_s/2$ is the anisotropy constant, β is the out-of-plane angle of the magnetization vector, $N_{zz}$ is the demagnetizing factor normal to the ribbon plane and $N_{yy}$ is the demagnetizing across the ribbon width. The solid line in FIG. 11*b* was calculated with the help of this expression and reproduces well the experimental domain size determined by magneto-optical investigations (squares in FIG. 11*b*).

Figure 11C:
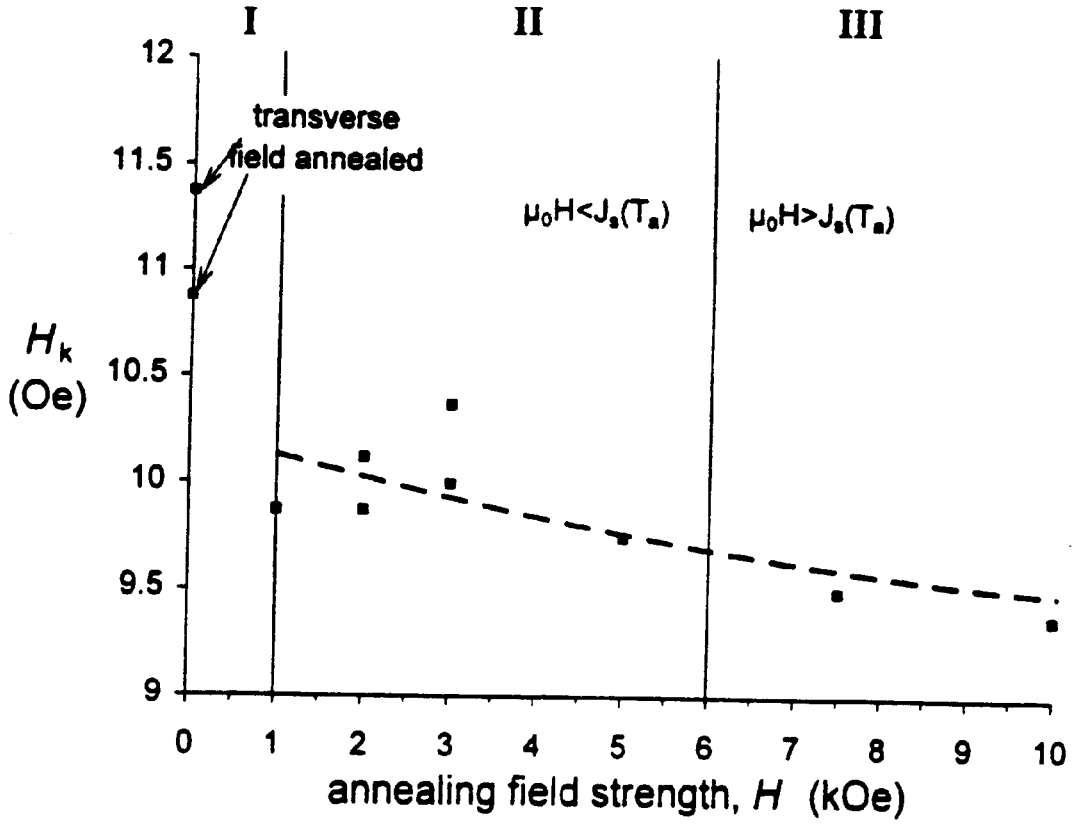

Three regions are indicated in FIGS. 11*a*, 11*b* and 11*c* by the roman numerals I, II and III (the boundary line between I and II is not sharply defined, i.e. the two ranges may overlap by about 0.5 kOe).

In region I the perpendicular annealing field is apparently too weak to induce an appreciable component of out-of-plane anisotropy which results in relatively wide slab domains comparable to the ones shown in FIG. 1. Region I also includes the transverse field-annealing technique of the prior art which are plotted at H=0. The perpendicular field annealing at these low field strengths, as can be seen, brings about no significant improvement of resonant signal amplitude compared to transverse field annealing. The domain width typically ranges between about 40μm and more than 100 μm in region I and is subject to relatively large scatter. Thus, for the transversely annealed samples the domain width actually varies between about 100μm (after 50 Hz demagnetization along the ribbon axis) and several hundreds of μm (e.g in the as annealed state or after demagnetization perpendicular to the ribbon direction) depending on the magnetic pre-history of the sample. These "unstable" domain widths are also observed for more perpendicularly oriented fields up to about 1 kOe. The domain widths shown in FIG. 11*b*, actually, are the ones obtained after demagnetizing the sample along the ribbon axis with a frequency of 50 Hz. In contrast, the domain width for the finer domain structures observed in regions II and III (i.e. at larger perpendicular annealing fields) is much more stable and less sensitive to the magnetic history of the sample.

Region II corresponds to annealing fields larger than about 1 kOe but smaller than about 6 kOe, i.e. smaller than the saturation magnetization at the annealing temperature. This results in an appreciable out-of-plane anisotropy angle of at least about 10° and in a finer, regular domain structure as e.g. exemplified in FIG. 8. The typical domain size in this annealing region ranges from about 10 μm to 30 μm. A significant improvement of resonant amplitude is found for annealing field strength above about 1.5 kOe, i.e. about one quarter of the saturation induction at the annealing temperature where the domain width becomes comparable or smaller than the ribbon thickness of about 25 μm which effectively reduces the excess eddy current losses described before. Field region II actually represents one preferred embodiment of this invention.

In region III, finally, i.e. after annealing at field strengths larger than larger than the saturation magnetization at the annealing temperature a more irregular "labyrinth" domain pattern can be observed, which is characteristic of a perpendicular anisotropy as exemplified in FIG. 2. Yet the domain width becomes smallest in this region, i.e. about 6 μm fairly independent of the annealing field strength. This particular fine domain structure results in particularly high magnetoresonant amplitudes due to the most efficient reduction in excess eddy current losses. The signal enhancement of magnetoelastic resonators by annealing an amorphous ribbon accordingly are another embodiment of the invention.

FIG. 11*c* shows the behavior of the anisotropy field $H_k$. Interestingly the anisotropy field of the perpendicularly annealed ribbons is about 10% smaller than the one of the transverse field annealed ribbons. This difference has been confirmed in many comparative experiments. The most likely origin of this effect is related to the closure domains being formed when the magnetic easy axis tends to point out of the ribbon plane. The closure domains reveal a magnetization component along the ribbon axis either parallel or antiparallel. When magnetizing the ribbon with a magnetic field along the ribbon axis, the domains oriented more parallel to that field will easily grow in size and the ones antiparallel to the field will shrink. Thus, the energy needed to turn the bulk domains out of their easy direction is diminished by the fraction of the magnetization component parallel to the ribbon compared to the magnetization component perpendicular to the ribbon axis. Accordingly a lower field strength $H_k$ is needed to saturate the ribbon ferromagnetically. Quantitatively the effective anisotropy field thus can be expressed by $$H_k = \frac{2K_u}{J_s} \cdot \left(1 - \frac{w}{2t}\sin\beta\right) \tag{7a}$$

where $K_u$ is the induced anisotropy constant, $J_s$ is the saturation magnetization, w is the domain width of the stripe domains, t is the ribbon thickness and β is the out-of-plane angle of the magnetic easy axis. $K_u$ is experimentally obtainable by measuring the effective anisotropy field $H_k^{trans}$ of a transversely annealed sample where β=0 i.e. $K_u = H_k^{trans} J_s/2$. The ribbon thickness t can e.g. be determined by a gauge or other suitable methods and the domain width w is obtainable from magneto-optical investigations. Thus, given a ribbon with oblique anisotropy, the anisotropy angle β can be determined by measuring $H_k$ of the ribbon and using the following formula $$\beta = \arcsin\left(\frac{2t}{w}\left(1 - \frac{H_k}{H_k^{trans.}}\right)\right) \tag{7b}$$

where $H_k^{trans}$ is the anisotropy field of a sample annealed under the same thermal conditions in a transverse magnetic field across the ribbon width. The triangles in FIG. 11*b* represent the thus-determined anisotropy angle which coincides well with the expected anisotropy angle calculated with eq. (5), the latter result being represented by the dashed line in FIG. 11*b*.

Figure 12A:
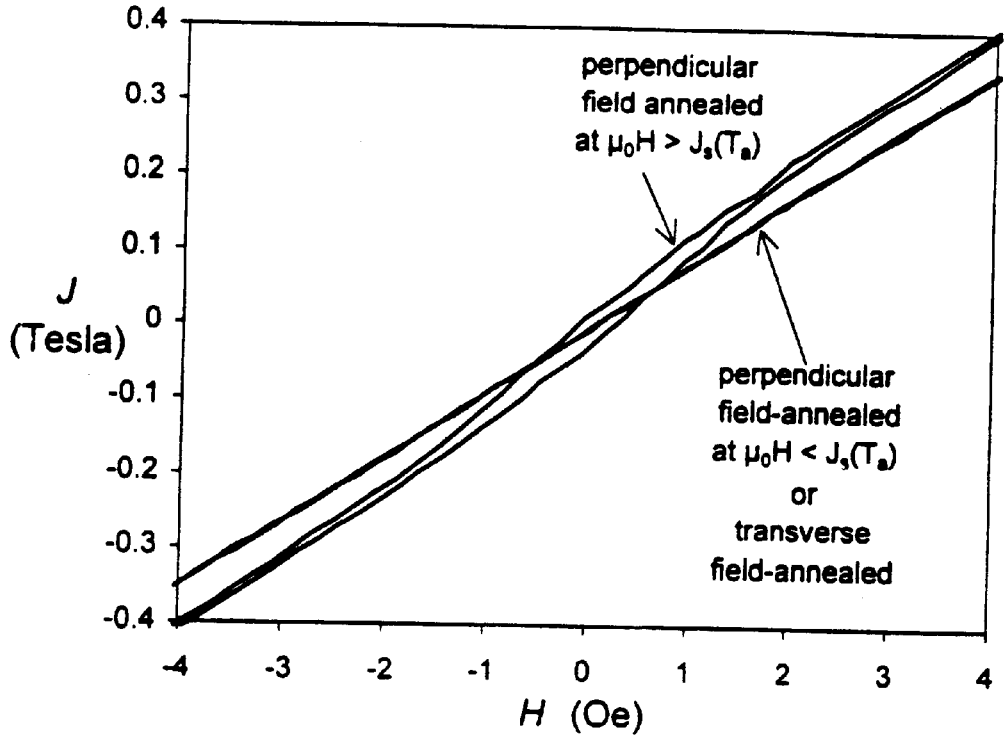
FIGS. 12*a* and 12*b* illustrate the role of the annealing field strength H on the linearity of the hysteresis loop for a field was acting essentially normal to the ribbon plane i.e. at an angle between about 85° and 90° except for the data points given at H=0 where a 2 kOe field was applied across the ribbon width.
Figure 12B:
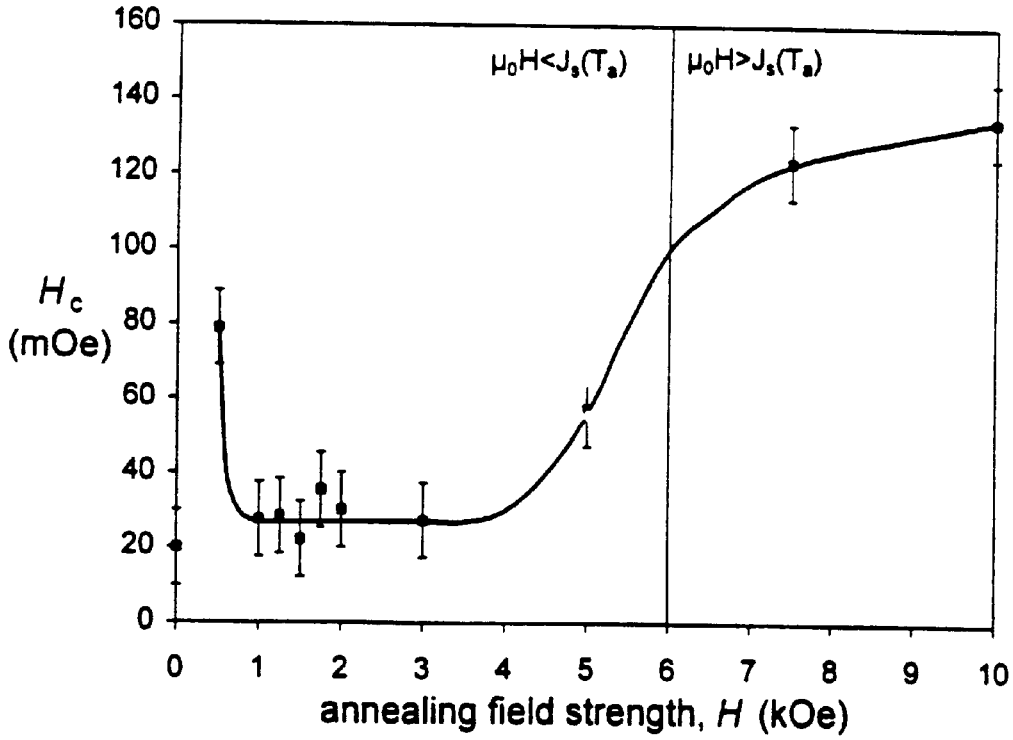

FIGS. 12*a* and 12*b* summarize the effect of the annealing field parameters on the linearity of the hysteresis loop. FIG. 12*a* is an enlargement of the center part of the loop and shows the typical loop characteristics for a transverse, oblique and pure perpendicular anisotropy, respectively. FIG. 12*b* quantifies the linearity in terms of the coercivity of the sample. Almost "perfectly" linear behavior, in these examples, corresponds to coercivities less than about 80 mOe.

Thus, a virtually perfectly linear loop can be obtained either by transverse field annealing at any sufficient field strength or by applying a substantially perpendicular field of at least about 1 kOe but below approximately the saturation magnetization at the annealing temperature, i.e. below about 6 kOe in the present example.

Influence of the annealing angle

In another set of experiments the influence of the angle of the magnetic annealing field was investigated. As shown in FIG. 6 the magnetic field during annealing was applied at an angle a measured between a line across the ribbon width and the direction of the field. There is nominally no field component along the ribbon axis. The results of these annealing experiments are summarized in FIGS. 13 and 14 and in Table II.

Table II

Effect of the field annealing angle a between the field direction and a line across the ribbon width on the angle β of the anisotropy axis with respect to the ribbon plane, the anisotropy field $H_k$, the maximum resonant amplitude $A1_{max}$ at the bias field $H_{Amax}$ and on the domain structure. Domain type I refers to the transverse slab domains exemplified in FIG. 1, type II refers to the closure domain structure of FIG. 8. The domain width was determined in the as annealed state and after demagnetizing the sample along the ribbon length with a frequency of 50 Hz. The examples refer to an amorphous $Fe_{24}Co_{18}Ni_{40}Si_2B_{16}$ alloy annealed in a continuous mode at 350° C. for about 6 s in a field of 3 kOe strength.

| | | | | | | | Domain width (μm) | |
|---|---|---|---|---|---|---|---|---|
| Nr | α | β | $H_k$ | $H_{Amax}$ (Oe) | $A1_{max}$ (mV) | Domain type | demag-netized | as annealed |
| 1 | 0° | 0° | 11.4 | 6.5 | 72 | I | 120 | 150–200 |
| 2 | 30° | 3° | 11.0 | 6.8 | 76 | I(II?) | 30 | 125 |
| 3 | 60° | 12° | 10.6 | 6.8 | 88 | II | 16 | 20 |
| 4 | 88° | 30° | 10.0 | 6.3 | 90 | II | 12 | 14 |

Figure 13A:
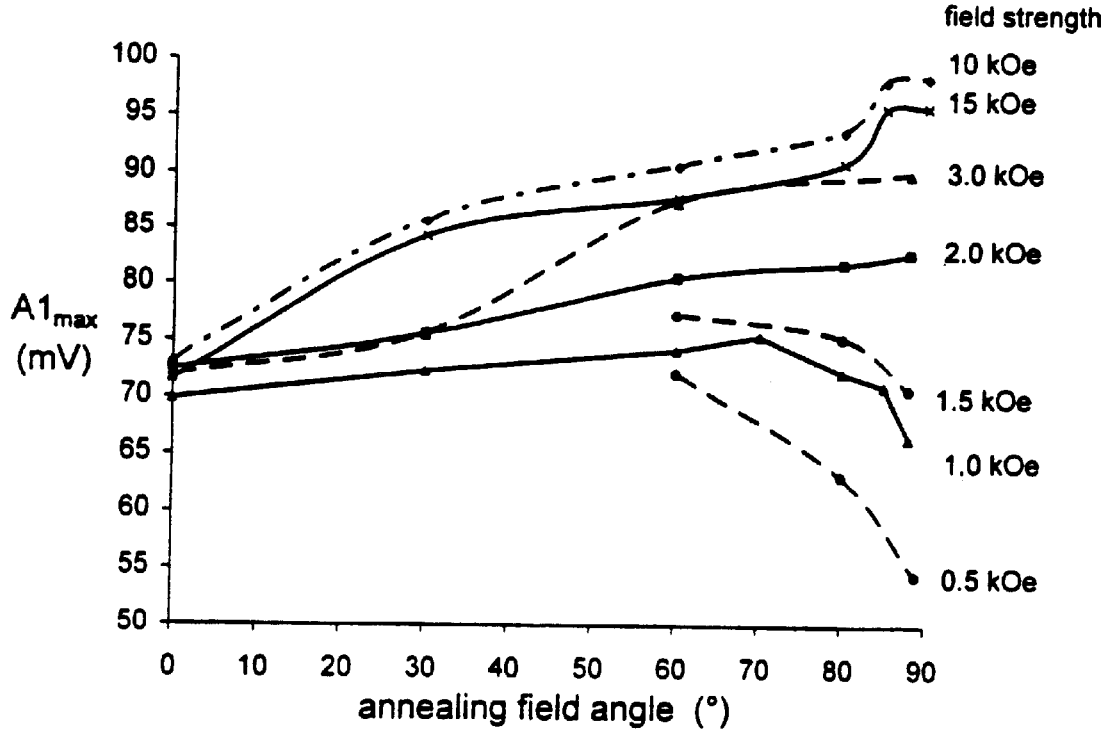
FIGS. 13*a* and 13*b* demonstrate the influence of the strength and the orientation of the magnetic annealing field on the resonant signal amplitude.
Figure 13B:
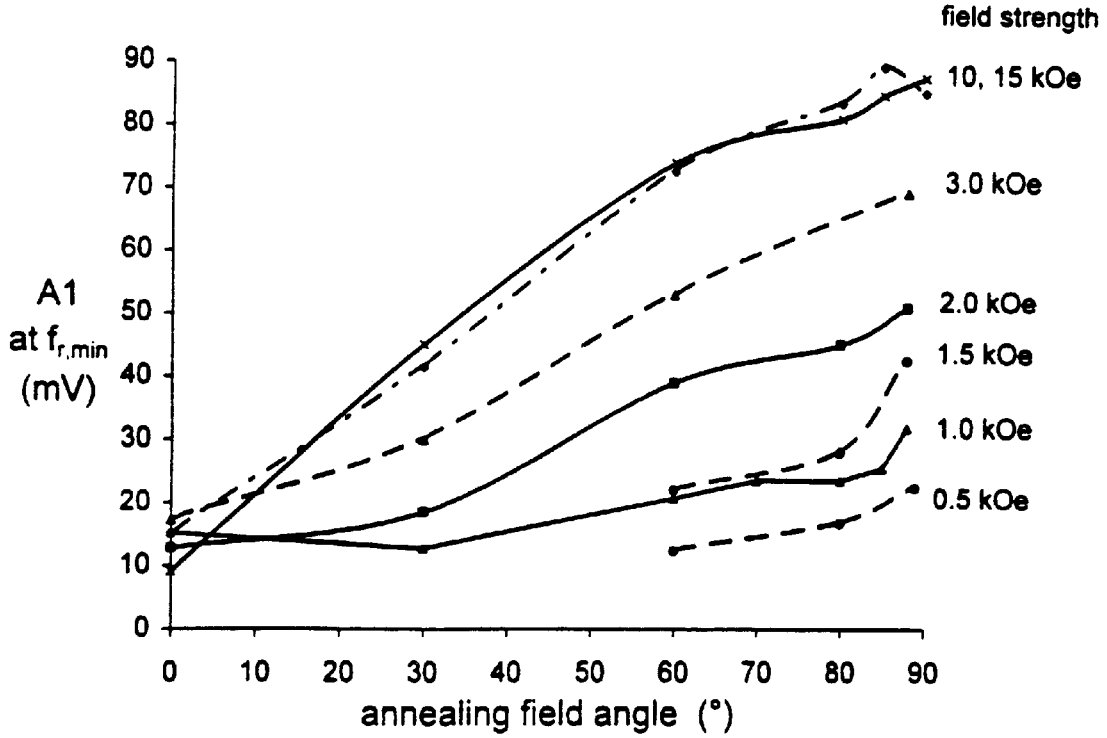

FIGS. 13*a* and 13*b* demonstrate the effect of the field annealing angle a on the resonant signal amplitudes for various field annealing strengths. For field strengths above about 1.5 kOe the resonant susceptibility is significantly improved as the field annealing angle exceeds about 40° and approaches a maximum when the field is essentially perpendicular to the ribbon plane i.e. when a approaches 90°.

FIGS. 13*a* and 13*b* also demonstrate that there is virtually no significant effect of the annealing field strength on the magneto-resonant properties when a transverse (0°) field-anneal treatment according to the prior art is employed.

Figure 14:
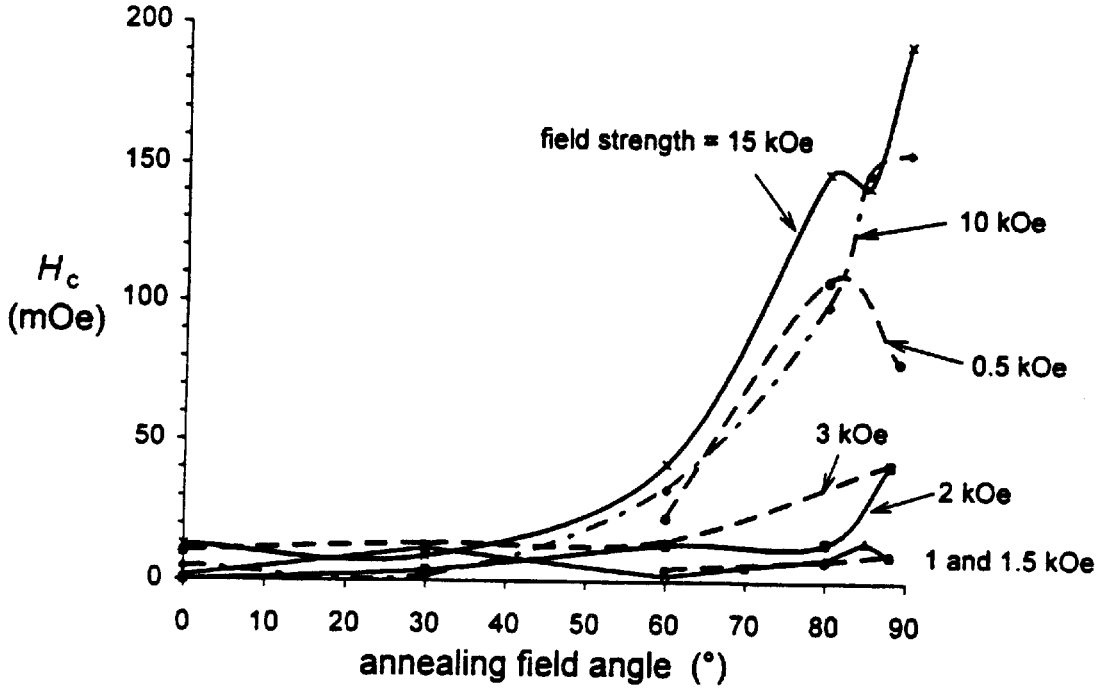
FIG. 14 demonstrates the influence of the strength and the orientation of the magnetic annealing field on the linearity of the hysteresis loop in terms of the coercivity $H_c$; the particular results shown were obtained for an amorphous $Fe_{24}Co_{18}Ni_{40}Si_2B_{16}$ alloy annealed in a continuous mode for about 6 s at 350° C. in a magnetic field of orientation and strength as indicated.

FIG. 14 shows the coercivity $H_c$ for the same set of parameters in order to illuminate the linearity of the hysteresis loop. Again, linear behavior, in these examples, corresponds to coercivities less than about 80 mOe. Substantial deviations from a perfect linear behavior again are only found in the samples annealed perpendicularly at 10 and 15 kOe i.e. in a field larger than the magnetization at the annealing temperature. Yet the linearity at these high annealing field is readily improved if the annealing field angle is less than about 70° to 80°.

A linear loop and simultaneously the highest signal amplitudes are found in those ribbons having been annealed in high (10–15 kOe), obliquely oriented (α≈30°–70° ) magnetic fields. This is another embodiment of the invention.

For moderate fields in the range between about 1.5 kOe up to the value of the saturation magnetization at the annealing temperature (i.e. about 6 kOe in these examples) the best signal amplitudes result if the field is oriented substantially perpendicular which means annealing angles above about 60° up to about 90°, which is a preferred embodiment of the invention.

Again, the resonant amplitude was closely related to the domain structure. The examples given in Table II demonstrate that, for moderate field strengths, the domain structure changes from wide stripe domains to narrow closure domains when the annealing angle exceeds 60° which is accompanied by a significant increase of the resonant signal amplitude.

At this point it is important to define more precisely what is meant by "substantially perpendicular" or "close to 90°", respectively. This terminology means that the annealing angle should be close to 90°, i.e. about 80° to 89° but not perfectly 90°. The present understanding of the inventor is that it should be avoided to orient the annealing field perfectly perpendicular to the ribbon plane—in a strict mathematical sense. This is an important point for the case of the annealing field being smaller than the magnetization at the annealing temperature, i.e., when the magnetization is not completely oriented normal to the plane during annealing. The physical background can be understood as described in the following.

An oblique anisotropy axis with one vectorial component perpendicular to the plane and one vectorial component across the ribbon width is needed. Accordingly the magnetization has to be oriented in the same manner during the annealing treatment.

First, assume a field is applied perfectly perpendicular to the plane but not strong enough to turn the magnetization vector completely out of the plane. The in-plane component of the magnetization then tends to orient along the ribbon axis t rather than perpendicular to it. One reason is that the demagnetizing factor along the continues ribbon is at least one order of magnitude less than the factor across the ribbon width. Another reason is the that tensile stress needed to transport the ribbon through the oven during annealing yields a magnetic easy axis along the ribbon axis (for a positive magnetostriction). As a final consequence the induced magnetic easy axis will be oriented obliquely along the ribbon axis i.e. with one vectorial component perpendicular to the plane, as desired, but with another vectorial component along the ribbon axis instead of across the ribbon width. This longitudinal anisotropy component tends to align the domains along the ribbon axis giving rise to an enhanced contribution of domain wall displacements. The consequence is a non-linear loop and diminished magnetoelastic response.

Figure 15A:
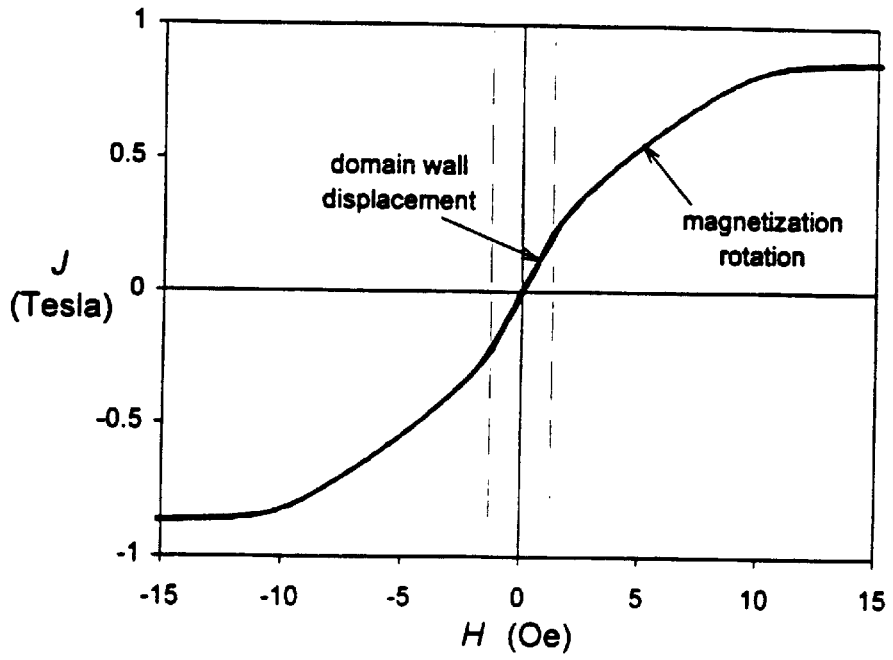
FIGS. 15*a* and 15*b* show an example for the deterioration of the linearity of the hysteresis loop and the magnetoresonant properties if the induced anisotropy has component along the ribbon axis.
Figure 15B:
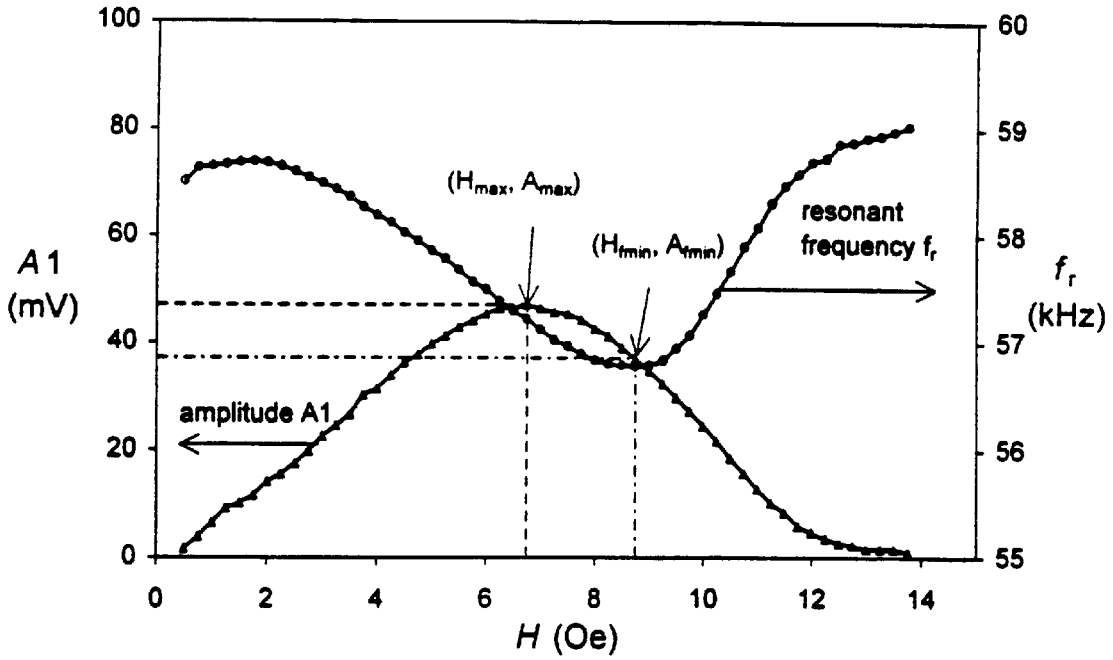

The inventor became aware of this mechanism from an experiment at moderate annealing fields wherein special emphasis was put on orienting the ribbon plane "perfectly" perpendicular to the annealing field. The results are shown in FIGS. 15*a* and 15*b* and illustrate the non-linear hysteresis loop and the poor magneto-resonant response obtained in this experiment. The domain structure investigations showed that a substantial part of the ribbon revealed domains oriented along the ribbon axis being responsible for the non-linear hysteresis loop and the diminished resonant response.

Thus, what is needed is a driving force, which during annealing orients the in-plane component of the magnetization across the ribbon width. The simplest but most effective way of achieving this is turning the normal of the ribbon plane a little bit away from the field direction. This produces a transverse in-plane component $H_y$ of the magnetic field which is given by $$H_y = H\cos a \tag{8}$$

This transverse field component $H_y$ should be strong enough to overcome the demagnetizing field and the magnetoelastic anisotropy fields at the annealing temperature. That is the minimum field $H_m^{min}$ across the ribbon width should be at least $$H_y^{min} \approx N_{yy} J_s(T_a)/\mu_0 + 3\lambda_s(T_a)\sigma/J_s(T_a) \quad (9)$$

Accordingly, the angle of the annealing field should be $$\alpha \leq \arccos \frac{H_y^{min}}{H} \quad (10)$$

In eqs. (8) through (10) H is strength and $\alpha$ is the out-of-plane angle of the magnetic field applied during annealing, $J_s(T_a)$ is the spontaneous magnetization at the annealing temperature $T_a$, $\lambda_s(T_a)$ is the magnetostriction constant at the annealing temperature $T_a$, $\mu_0$ is the vacuum permeability, $N_{yy}$ is the demagnetizing across the ribbon width and $\sigma$ is the tensile stress in the ribbon.

Typical parameters in the experiments are $T_a \approx 350°$ C., $N_{yy} \approx 0.004$, $J_s(T_a) \approx 0.6$ T, $\lambda_s(T_a) \approx 5$ ppm and $\sigma \approx 100$ MPa. This yields a minimum field of about $H_y^{min} \approx 55$ Oe which is to be overcome in the transverse direction. Hence, for a total annealing field strength of 2 kOe this would mean that the annealing angle should be less than about 88.50°.

Actually, such small deviations from 90° often are more or less automatically produced by the "imperfections" in the experimental set-up owing e.g. to field inhomogeneities or imperfect adjustment of the magnets.

Even more, such small deviations from the 90° angle may naturally occur since the magnetic field tends to orient the ribbon plane into a position parallel to the field lines. FIGS. 16*a* and 16*b* give an illustrative example. FIGS. 16*a* and 16*b* show the cross section of a mechanical annealing fixture 5 which helps to orient the ribbon 4 in the oven. If the opening 5*a* of this fixture 5 is larger than the ribbon thickness, the ribbon 4 will automatically be tilted by the torque of the magnetic field although everything else is perfectly adjusted. The resulting angle a between the ribbon plane and the magnetic field is determined by the width h of the opening and the width b of the ribbon, i.e.

$$\alpha \approx \arccos \frac{h}{b} \quad (11)$$

Even for a relatively narrow opening width of about h≈0.2 mm the resulting angle, for a 6 mm wide ribbon will be about $\alpha \approx 88°$. This deviation from 90° is enough to produce a sufficiently high transverse field to orient the in-plane component of the magnetization across the ribbon width. The width h of the opening 5*a* in the annealing fixture 5 should not exceed about half of the ribbon width. Preferably the opening should be not more than about one fifth of the ribbon width. In order to allow the ribbon to move freely through the opening the width h should be preferably at least about 1.5 times the average ribbon thickness.

Thus "substantially" perpendicular means an orientation very close to 90°, but a few degrees away in order to produce a sufficiently high transverse field as explained above. This is also what is meant when sometimes the term "perpendicular" is used by itself in the context of describing the invention. This is in particular true for field strengths below about the saturation magnetization at the annealing temperature. Thus, the annealing arrangement as for example shown in FIG. 16*b*, where the applied field is perfectly perpendicular to the ribbon plane, is less suited.

In most of the examples discussed thus far the ribbon plane was more or less automatically tilted out of a perfect 90° orientation due to the construction of the annealing fixture.

The annealing fixture described is necessary in guiding the ribbon through the furnace. It particularly avoids the ribbon plane being oriented parallel to the field lines which would result in a transverse field-anneal treatment. Yet a further purpose of the annealing fixture can be to give the ribbon a curl across the ribbon width. As disclosed in European Application 0 737 986 such a transverse curl is important for avoiding magnetomechanical damping due to the attractive force of the resonator and the bias magnet. Such types of annealing fixtures are schematically shown [on the] in FIG. 17*c* and FIG. 17*d*. In such a type of annealing fixture the ribbon has virtually no chance to be turned by the torque of the magnetic field. As a consequence, if such curl annealing fixtures are used it becomes essential to properly orient the annealing field so that the normal of the ribbon plane is a few degrees away from the field direction.

If, at moderate field strength, a substantially perpendicular field is applied during annealing and if the magnetoresonant response is bad or the losses are too high, it is only necessary to change the orientation between the field and the ribbon normal by a few degrees. As simple as this rule is, it is most crucial and represents another preferred embodiment of this invention.

Example of annealing equipment

In practice establishing highest magnetic fields on a relatively large scale is associated with technical problems and with cost. It is thus preferable to perform the perpendicular field-annealing method at field strengths which are easily accessible and which at the same time yield a significant property enhancement.

An important factor of the invention is that, unlike as believed hitherto field strength which aligns the magnetization parallel to the field direction is not necessary, but a moderate field can be very efficient and more suitable.

Field strengths up to about 8 kOe in a magnet system can be achieved technically without significant problems. Such a high field magnet yoke can be built for virtually any length with a gap width up to about 6 cm, which is wide enough to place an oven into the gap.

Although desirable, such high field strengths are not necessarily required. The above experiments have shown that the application of a field of about 2–3 kOe oriented substantially perpendicular to the ribbon plane can be more than sufficient to achieve the desired property enhancement. Such a magnet system has the advantage that it can be built with a wider gap up to about 15 cm in width and at reduced magnet costs.

After describing how to build an annealing equipment with such a magnet system, further examples of experiments conducted with a relatively moderate "perpendicular" field of 2 kOe will be described.

Figure 18:
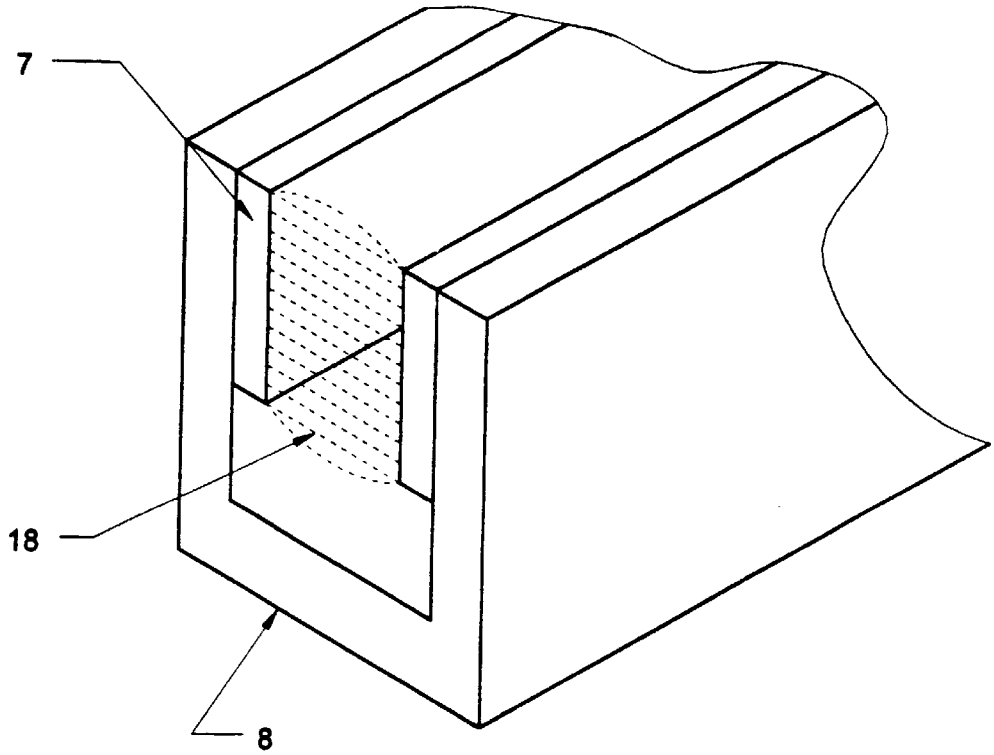
FIG. 18 is a view of a magnet system formed by a yoke and permanent magnets which produces the designated magnetic field lines in the inventive method.

FIG. 18 is a three dimensional view of a magnet system which typically includes permanent magnets 7 and an iron yoke 8. The magnetic field in the gap 18 between the magnets has a direction along the dashed lines and has a strength of at least about 2 kOe. The magnets are preferably made of a FeNdB-type alloy which, for example, is commercially available under the tradename VACODYM. Such magnets are known to be particularly strong, which is advantageous in order to produce the required field strength.

Figure 19A:
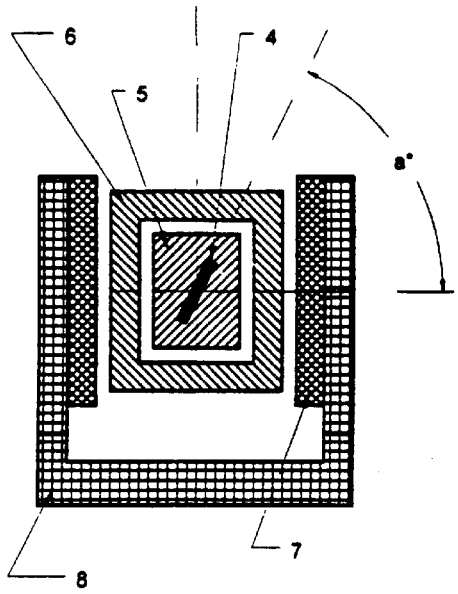
FIGS. 19*a* and 19*b* show an example for continuously annealing a straight ribbon according to the principles of this invention.

FIG. 19*a* shows the cross section of such a magnet system 7,8 with an oven 6 in-between, in which the ribbon 4 is transported at the desired angle with respect to the field direction by the help of an annealing fixture 5. The outer shell of the oven 6 should be insulated thermally such that the exterior temperature does not exceed about 80° C.

Figure 19B:
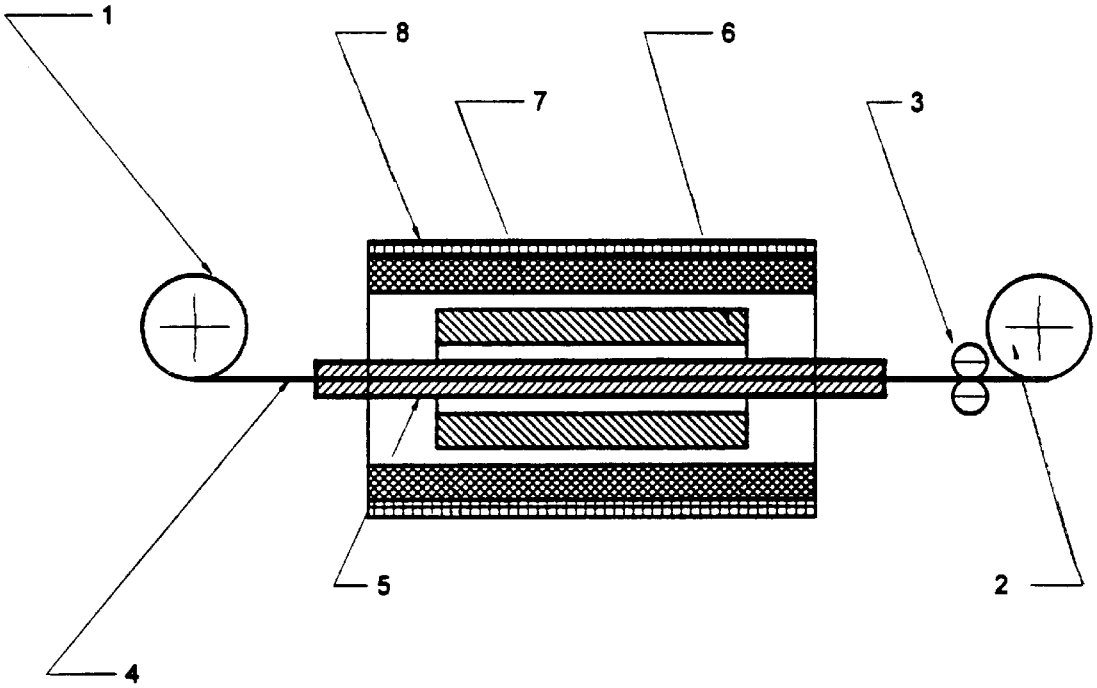

FIG. 19*b* shows a longitudinal section of the magnet system 7,8 and the oven 6 inside the magnet. The ribbon 4 is supplied from a reel 1 and transported through the oven by the rollers 3 which are driven by a motor and finally wound up on the reel 2. The annealing fixture 5 guarantees that the ribbon is transported through the oven in a possibly straight way, i.e. there must be no accidental or inhomogeneous bending or twisting of the ribbon which would be "annealed in" and which would deteriorate the desired properties.

The ribbon should be subjected to the magnetic field as long as it is hot. Therefore the magnet system 7,8 should be about the same length as the oven 6, preferably longer. The annealing fixture 5 should be at least about as long as the magnet and/or the oven, preferably longer in order to avoid property degradation due to the aforementioned bending or twisting originating from the forces and the torque exerted to the ribbon by the magnetic field. Furthermore, mechanical tensile stress along the ribbon axis is helpful to transport the ribbon in a straight path through the oven. This stress should be at least about 10 MPa, preferably higher i.e. about 50–200 MPa. It should, however, not exceed about 500 MPa since the probability of the ribbons breaking (originated by small mechanical defects) increases at stress levels which are too high. A tensile stress applied during annealing also induces a small magnetic anisotropy either parallel or perpendicular to the stress axis, depending on the alloy composition. This small anisotropy adds to the field induced anisotropy, and thus affects the magnetic and magneto-elastic properties. The tensile stress should therefore be kept at a controlled level within about +/−20 MPa.

The aforementioned annealing fixture is also important to support the ribbon at the desired angle with respect to the field. A ferromagnetic ribbon has a tendency to align itself such that the ribbon plane is parallel to the field lines. If the ribbon were not supported, the torque of the magnetic field would turn the ribbon plane parallel to the field lines which would result in a conventional transverse field annealing process.

FIGS. 17*a–d* show a more detailed view of how the cross section of said annealing fixture may look. The annealing fixture preferably is formed by separate upper and lower parts (10 and 9 in FIG. 17*a*, and 12 and 11 in FIG. 17*b*) between which the ribbon can be placed after which these two parts are put together. The examples given in FIGS. 17*a* and FIG. 17*b* are intended only to guide the ribbon through the furnace. As noted earlier, the annealing fixture additionally can be used to give the ribbon a curl across the ribbon width, as shown in FIG. 17*c* and FIG. 17*d*, respectively. The fixture shown in FIG. 17*c* has a lower part 13 and an upper part 14 which in combination define a curved opening. The fixture shown in 17*d* has a lower part 15 and an upper part 16 which can be used to produce either a rectangular opening, by inserting respective strips into the uppermost rectangular channel in the upper part 16 and in the lowermost rectangular channel in the lower part 15 or, by leaving those uppermost and lowermost channels open and using a longitudinal supporting element 17, an opening suitable for producing curved ribbon can be obtained. These fixtures are equally suited for the annealing method according to this invention. In the latter type of annealing fixtures the ribbon has virtually no chance to be turned by the torque of the magnetic field. As a consequence, if such a curl annealing fixture is used it becomes important to properly orient the annealing field such that the normal of the ribbon plane is a few degrees away from the field direction which, as described before, is particularly important at moderate annealing field strengths.

Several annealing fixtures according to FIG. 17*a–d* were tested and proved to be well suited. It proved to be important for the fixture to be at least as long as the oven 6 and preferably longer than the magnet 7,8 in order to avoid twisting or bending due the mechanical torque and force exerted by the magnetic field.

The annealing fixtures tested were made of ceramics or stainless steel. Either material proved to be well suited. Both materials reveal no or only weak ferromagnetic behavior. Thus, they are easy to handle within the region of the magnetic field. That is, the fixture can be assembled and disassembled in situ easily which may be necessary if the ribbon breaks or when loading a new ribbon. This does not exclude, however, the suitability of a ferromagnetic material for the construction of the annealing fixture. Such a ferromagnetic device could act as a kind of yoke in order to increase the magnetic field strength applied to the ribbon, which would be advantageous to reduce the magnet costs.

Figure 20A:
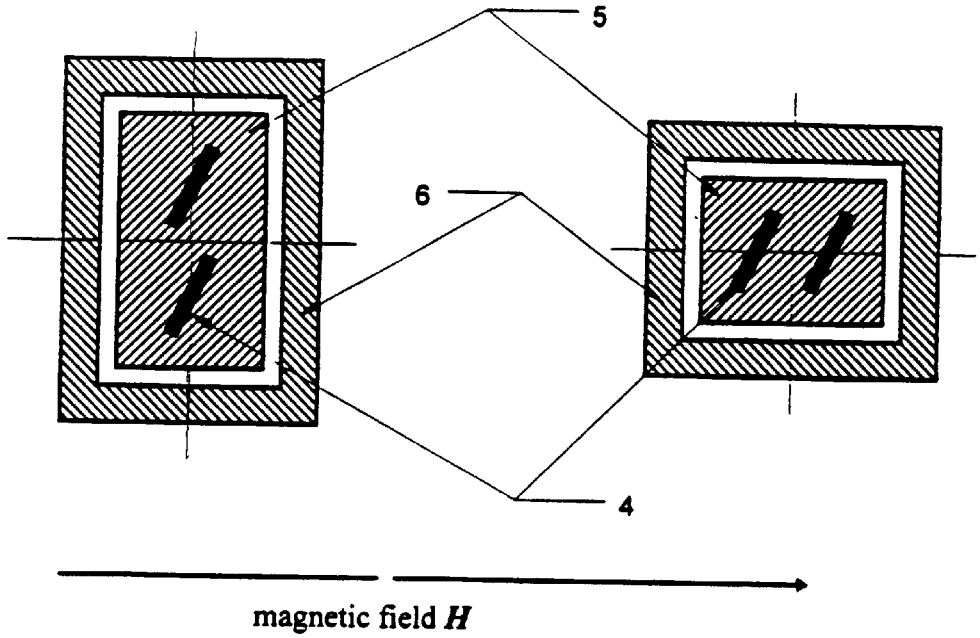
FIGS. 20*a* and 20*b* show the principles of a multilane annealing device according to the invention.
Figure 20B:
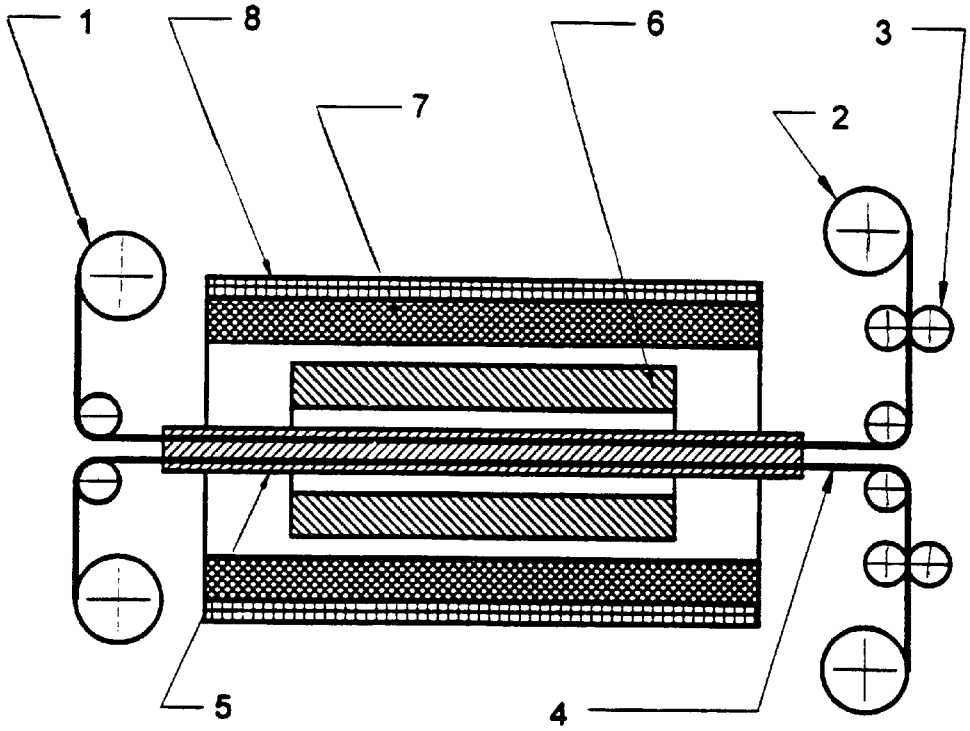

For simplicity FIGS. 19*a* and 19*b* show only a single ribbon being transported through the oven 6. In a preferred embodiment, however, the annealing apparatus system should have at least a second lane with the corresponding supply and wind-up reels, in which a second ribbon is transported through the oven 6 independently but in the same manner as in the first lane. FIGS. 20*a* and 20*b* schematically show such a two lane system. Such two or multiple lane systems enhance the annealing capacity. Preferably, the individual lanes have to be arranged in such a way that there is enough space so that a ribbon can be "loaded" into the system while the other lane(s) are running. This again enhances capacity, particularly in the case of the ribbon in one lane breaks during annealing. This break can then be fixed while the other lanes keep on running.

In the multilane oven the individual lanes all can be put into the same oven or alternatively an oven of a smaller diameter can be used for each individual lane. The latter may be advantageous if the ribbons in the different lanes require different annealing temperatures.

Figure 21:
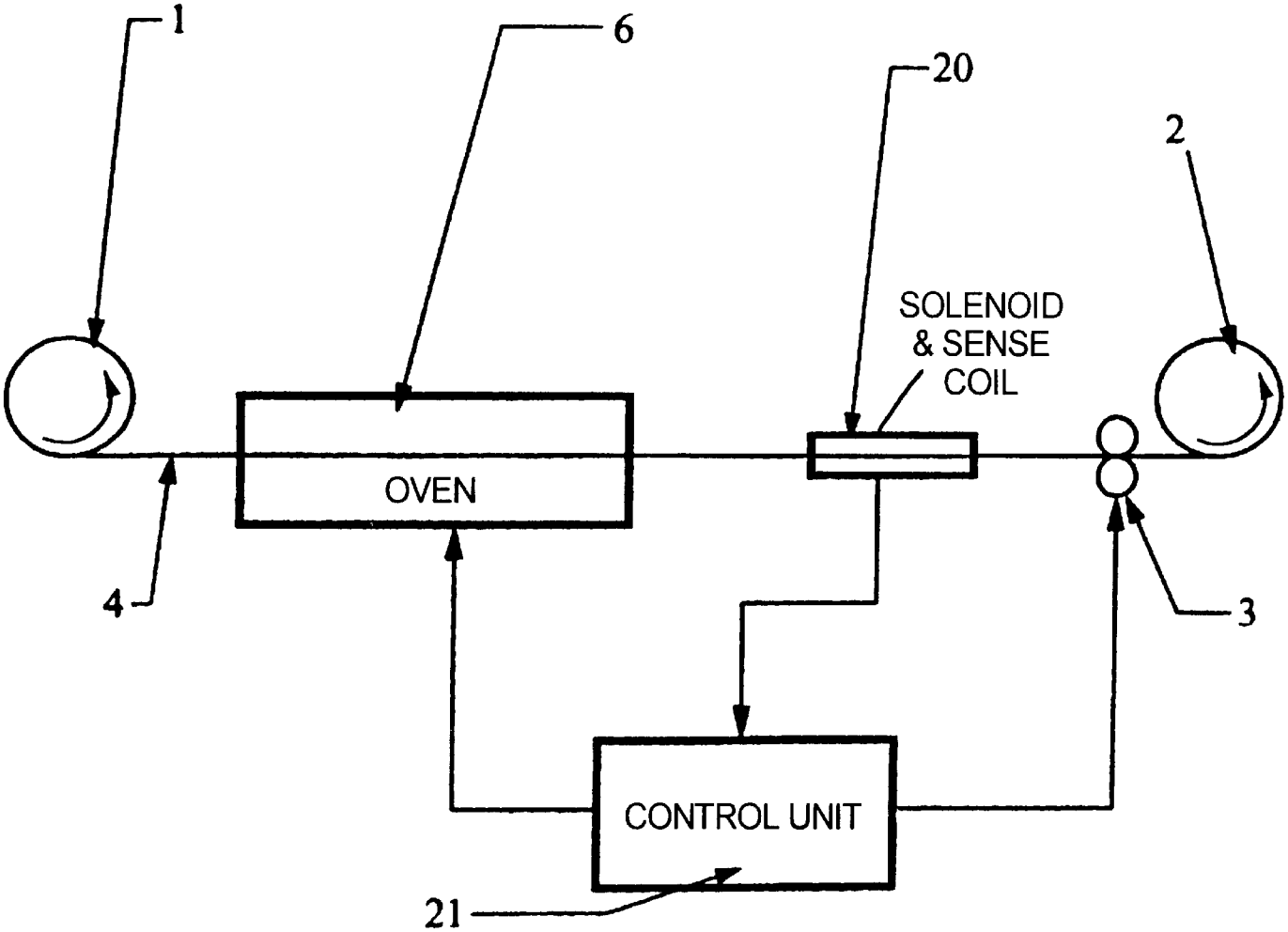
FIG. 21 shows the principles of a feed-back control of the annealing process according to the invention.

The magnetic properties, like e.g. the resonant frequency or bias field for the maximum resonant amplitude have a sensitive dependence on the alloy composition and the heat treatment parameters. On the other hand these properties are closely correlated to the properties of the hysteresis loop like e.g. the anisotropy field or the permeability. Thus, a further improvement is to provide an on-line control of the magnetic properties during annealing, which is schematically sketched in FIG. 21. This can be realized by guiding the annealed ribbon 4 through a solenoid and sense coil 20 before winding it up. The solenoid produces a magnetic test field, the response of the material is recorded by the sense coil. In that way the magnetic properties can be measured during annealing and corrected to the desired values by means of a control unit 21 which adjusts the annealing speed, the annealing temperature and/or the tensile stress along the ribbon, accordingly. Care should be taken that in the section where the ribbon properties are measured, the ribbon is subjected to as little tensile stress as possible, since such tensile stress, via magnetostriction, affects the magnetic properties being recorded. This can be achieved by a "dead loop" before the ribbon enters solenoid and the sense coil 20. Accordingly a multilane oven has several such solenoids and sense coils 20 such that the annealing parameters of each individual lane can be adjusted independently.

In a preferred embodiment of such an annealing system, the magnetic field is about 2–3 kOe and is oriented at about 60° to 89° with respect to the ribbon plane. Preferably the magnet system 7,8 and the oven 6 are at least about 1 m, long preferably more, which allows high annealing speeds of about 5–50 m/min.

Further Examples A further set of experiments tested in more detail one preferred embodiment of the invention, which is annealing the ribbon in a magnetic field of relatively moderate strength i.e. below the saturation magnetization of the material at the annealing temperature and oriented perpendicular to the ribbon plane i.e. more precisely at an angle between about 60° and 89° with respect to a line across the ribbon width.

For the particular examples discussed in the following a field strength of about 2 kOe was used, produced by a permanent magnet system as described before. The magnetic field was oriented at about 85° with respect to the ribbon plane which results in an oblique anisotropy i.e. a magnetic easy axis perpendicular to the ribbon axis but tilted by approximately 10° to 30° out of the ribbon plane. Linear hysteresis loops with enhanced magnetoresonant response were obtained in this way. These results are compared with those obtained when annealing in a field across the ribbon width (transverse field) according to one method of the prior art which also yields linear hysteresis loops.

The experiments were conducted in a relatively short oven as described above. The annealing speed was about 2 m/min, which for this oven, corresponds to an effective annealing time of about 6 seconds. The magnetic and magnetoresonant properties among others are determined by the annealing time which can be adjusted by the annealing speed. In a longer oven, the same results were achieved but with an appreciably higher annealing speed of e.g. 20 m/min.

Effect of annealing temperature and time

Figure 22A:
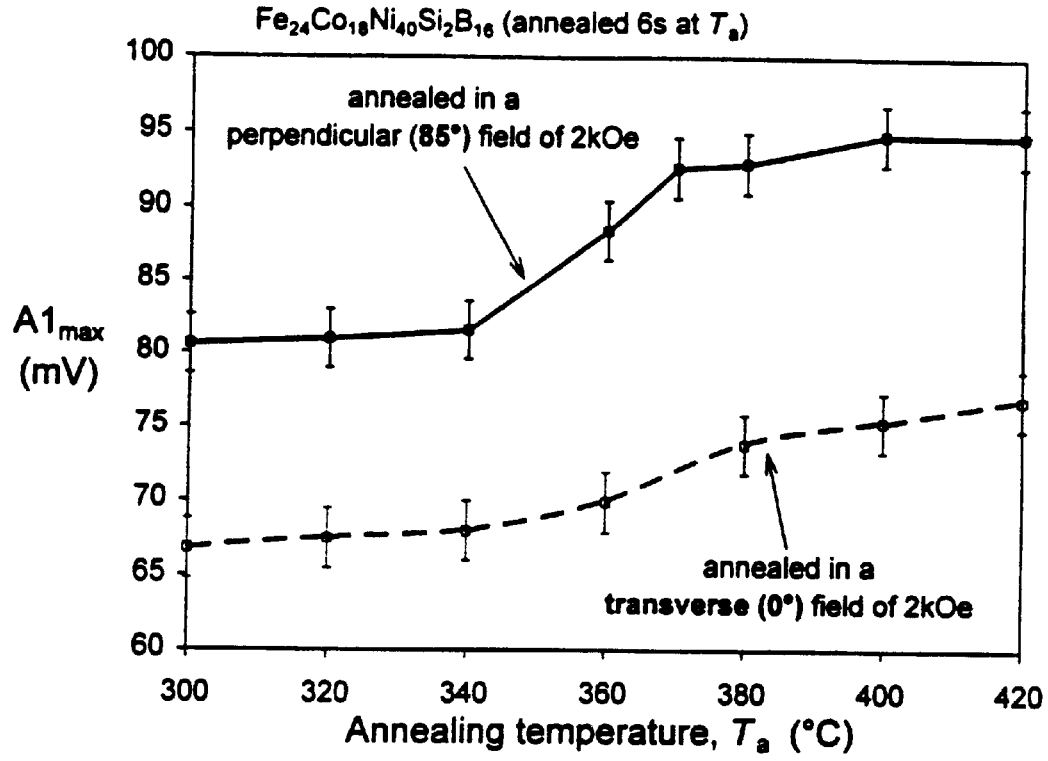
FIGS. 22*a* and 22*b* compare the resonant signal amplitude of an amorphous $Fe_{24}Co_{18}Ni_{40}Si_2B_{16}$ alloy after annealing in a magnetic field oriented transverse to the ribbon (prior art) or at angle of about 85° between the field direction and a line across the ribbon width (the invention); the field strength was 2 kOe in each case and the ribbons were annealed in a continuous mode for about 6 s at annealing temperatures between about 300° C. and 420° C.
Figure 22B:
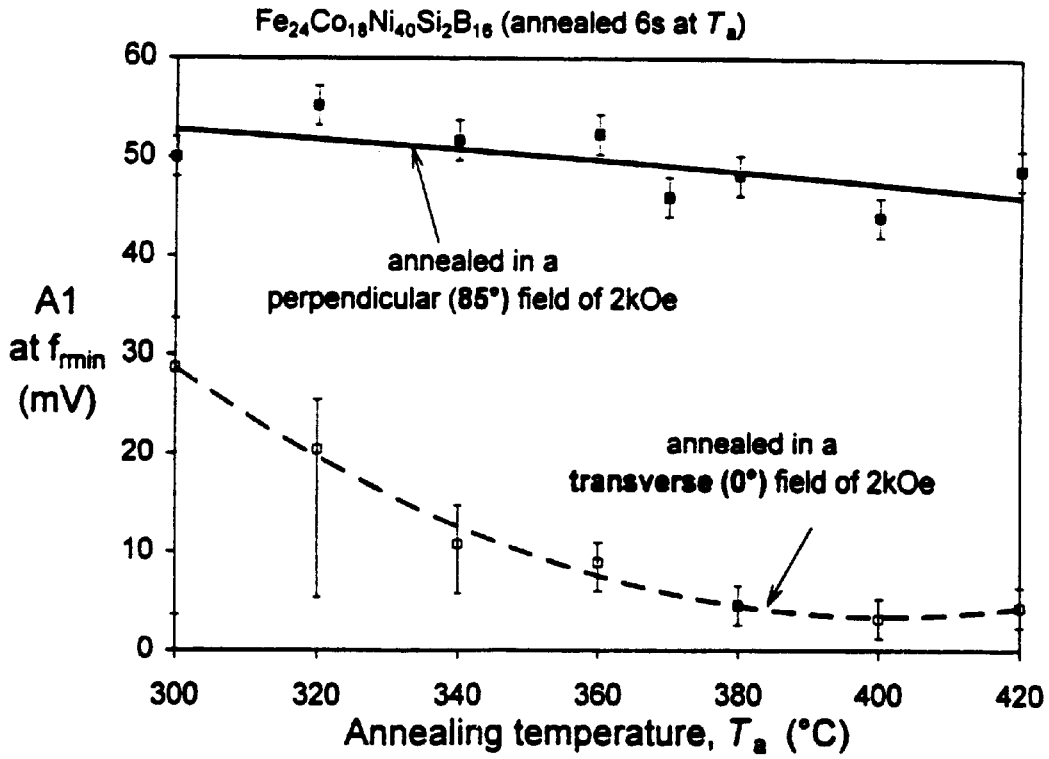
Figure 23:
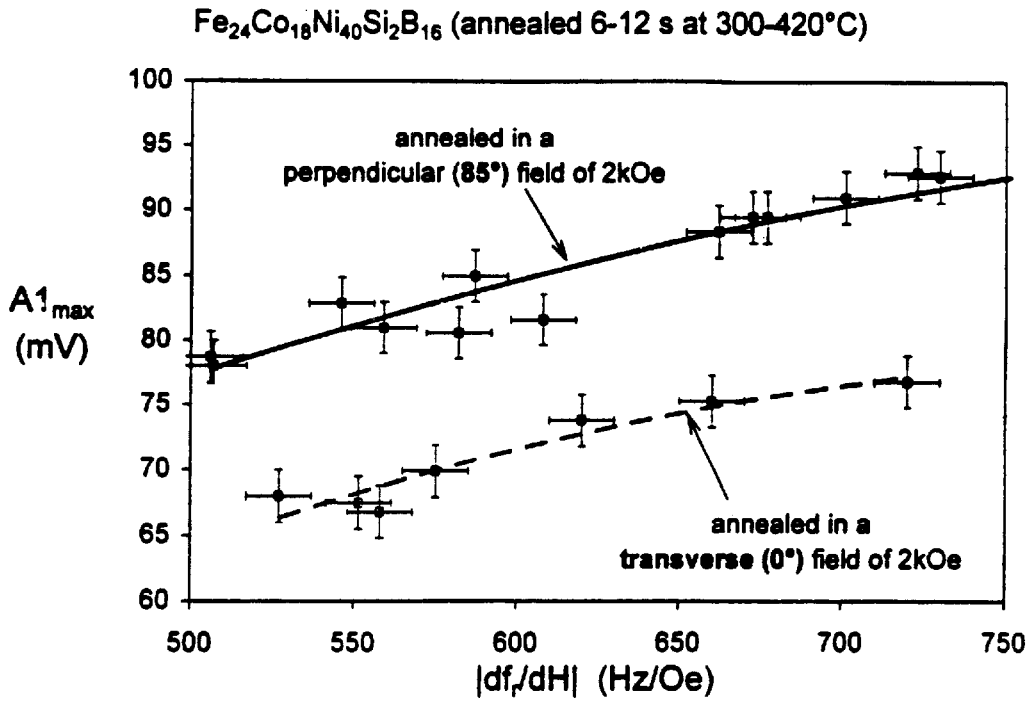
FIG. 23 is another comparison of the resonant signal amplitude of an amorphous $Fe_{24}Co_{18}Ni_{40}Si_2B_{16}$ alloy after annealing in a magnetic field oriented transverse to the ribbon (prior art) or at angle of about 85° between the field direction and a line across the ribbon width (the invention); the maximum amplitude is plotted versus the slope $|df_r/dH|$ at the bias where this maximum occurs; the field strength was 2 kOe in each case and the ribbons were annealed in a continuous mode for about 6 s–12 s at annealing temperatures between about 300° C. and 420° C.

In a first set of these experiments, an amorphous $Fe_{24}Co_{18}Ni_{40}Si_2B_{16}$ alloy was investigated in detail as to the effect of the annealing temperature and the annealing time. The results are listed Table III and are illustrated in FIGS. 22*a* and 22*b* and FIG. 23. The resonant frequencies in all these examples were located at frequencies bout 57 kHz at $H_{max}$ and around about 55 kHz at $H_{fmin}$. In all examples of Table III the ribbon was ductile after the annealing treatment.

A representative, more detailed example of the measured results has been already given in FIG. 9 which corresponds to example 4 listed in Table III.

TABLE III

Magnetoresonant properties of an amorphous $Fe_{24}Co_{18}Ni_{40}Si_2B_{16}$ alloy annealed in a continuous mode at the indicated annealing temperature $T_a$ at about the indicated time $t_a$ in a magnetic field of about 2 kOe strength oriented at about 85° (this invention) and 0° (prior art), respectively, with respect to an axis across the ribbon plane. $H_k$ is the anisotropy field, $H_{max}$ is the bias field where the resonant amplitude $A_1$ is maximum, $A_{max}$ is said maximum signal, |df/dH| is the slope of the resonant frequency $f_r$ at $H_{max}$, $H_{fmin}$ is bias field where the resonant frequency has its minimum, $A_{fmin}$ is the signal at said minimum, $\Delta f_r$ is the difference of the resonant frequency at a bias of 2 Oe and 6.5 Oe, respectively.

| | | | | results at maximum A1 | | | results at $f_{r,min}$ | | 6.5–>2Oe |
|---|---|---|---|---|---|---|---|---|---|
| Exp. Nr. | $T_a$ (° C.) | $t_a$ (s) | $H_k$ (Oe) | $H_{max}$ (Oe) | $A_{max}$ (mV) | \|df/dH\| (Hz/Oe) | $H_{fmin}$ (Oe) | $A_{fmin}$ (mV) | Δf, (kHz) |
| Inventive Examples-field oriented at about 85° | | | | | | | | | |
| 1 | 300 | 6 | 10.2 | 6.5 | 81 | 582 | 8.8 | 50 | 2.2 |
| 2 | 320 | 6 | 11.1 | 7.3 | 81 | 559 | 9.5 | 55 | 1.9 |
| 3 | 340 | 8 | 11.3 | 7.5 | 82 | 608 | 10.0 | 52 | 1.8 |
| 4 | 360 | 6 | 10.8 | 7.0 | 88 | 662 | 9.5 | 52 | 2.1 |
| 5 | 370 | 6 | 10.6 | 7.1 | 93 | 730 | 9.3 | 46 | 2.2 |
| 6 | 380 | 6 | 10.4 | 6.6 | 93 | 723 | 9.3 | 48 | 2.3 |
| 7 | 400 | 6 | 9.7 | 6.3 | 95 | 827 | 8.8 | 44 | 2.7 |
| 8 | 420 | 6 | 9.8 | 6.1 | 95 | 850 | 8.3 | 49 | 2.9 |
| 9 | 300 | 12 | 11.3 | 7.5 | 79 | 506 | 9.8 | 53 | 1.8 |
| 10 | 320 | 12 | 11.9 | 7.8 | 78 | 507 | 10.3 | 55 | 1.6 |
| 11 | 340 | 12 | 11.9 | 7.8 | 83 | 546 | 10.3 | 57 | 1.7 |
| 12 | 360 | 12 | 11.4 | 7.5 | 85 | 587 | 10.0 | 56 | 1.8 |
| 13 | 370 | 12 | 11.1 | 7.4 | 90 | 677 | 9.8 | 55 | 2.0 |
| 14 | 380 | 12 | 10.7 | 7.1 | 91 | 701 | 9.5 | 55 | 2.2 |
| 15 | 380 | 12 | 10.7 | 6.9 | 90 | 673 | 9.5 | 53 | 2.2 |
| 16 | 420 | 12 | 9.4 | 5.5 | 96 | 887 | 8.0 | 44 | 31 |
| Comparative examples of the prior art (transverse field) | | | | | | | | | |
| T1 | 300 | 6 | 10.9 | 6.0 | 67 | 558 | 9.0 | 29 | 2.0 |
| T2 | 320 | 6 | 11.9 | 6.9 | 68 | 552 | 10.3 | 20 | 1.6 |
| T3 | 340 | 6 | 123 | 7.4 | 68 | 527 | 10.8 | 11 | 1.5 |
| T4 | 360 | 6 | 12.0 | 7.1 | 70 | 575 | 10.5 | 9 | 1.7 |
| T5 | 380 | 6 | 11.5 | 6.8 | 74 | 620 | 10.3 | 5 | 1.9 |
| T6 | 400 | 6 | 10.8 | 6.0 | 75 | 660 | 9.5 | 3 | 2.3 |
| T7 | 420 | 6 | 10.4 | 5.6 | 77 | 720 | 9.0 | 4 | 25 |

FIGS. 22*a* and 22*b* demonstrate that the inventive annealing technique results in a significantly higher magnetoresonant signal amplitude compared to the conventional transverse field-annealing at all annealing temperatures and times. As mentioned before, the inventive technique also results in more linear hysteresis loops, which is an advantage compared to [another] annealing techniques of the prior art where the induced anisotropy is perpendicular to the ribbon plane.

The variation of the amplitude with the annealing temperature and annealing time is correlated with a corresponding variation of the resonant frequency versus bias field curve in FIGS. 22*a* and 22*b*. The latter is best characterized by the susceptibility of the resonant frequency $f_r$ to a change in the bias field H, i.e. by the slope $|df_r/dH|$. Table III list this slope at $H_{max}$ where the resonant amplitude has its maximum. At $H_{fmin}$, where the resonant frequency has its minimum, this slope is virtually zero i.e. $|df_r/dH|=0$.

In a marker for one major commercially available EAS system, the bias field is produced by a ferromagnetic strip placed adjacent to the amorphous resonator. The identity of the marker is its resonant frequency which at the given bias field should be as close as possible to a predetermined value, which e.g. may be 58 kHz and which is adjusted by giving the resonator an appropriate length. In practice, however, this bias field can be subject to variations of about ±0.5 Oe owing to the earth's magnetic field and/or due to property scatter of the bias magnet material. Thus the slope |df/dH| at the operating bias should be as small as possible in order to maintain the signal identity of the marker, which improves the pick-up rate of the surveillance system for the marker. One way of realizing this is to dimension the bias strip such that it produces a magnetic field where the resonant frequency is at its minimum i.e. where $|df/dH| \approx 0$. The detection rate of such a marker however, also depends on the resonant signal amplitude of the resonator. Thus, it may be even more advantageous to adjust the resonator material and/or the bias magnet such that the bias field is close to $H_{max}$ where the resonant signal has its maximum. The value of $|df_r/dH|$, however, should still be as small as possible. The frequency change due to accidental variations of the bias field should be smaller than about half the bandwidth of the resonant curve. Thus, for example, for tone bursts of about 1.6 ms, the slope at the operational bias should be less than about $|df/dH| < 700$ Hz/Oe.

FIG. 23 shows the maximum resonant amplitude at $H_{max}$ as a function of the slope $|df/dH|$ at $H_{max}$. FIG. 23 again demonstrates that the magnetoresonant signal amplitude achieved with the inventive annealing treatment is significantly higher than that after conventional transverse field-annealing. In particular, higher amplitudes A1 can be achieved at even at lower slopes $|df/dH|$ which both is of advantage.

The field $H_{max}$ at which the maximum amplitude is located typically ranges between about 5 Oe and 8 Oe. This corresponds to the bias field typically used in aforementioned markers. The bias fields produced by the bias magnets preferably should not be higher in order to avoid magnetic clamping due to the magnetic attractive force between the bias magnet and the resonant marker. Moreover, the bias field should not be so low as to reduce the relative variation owing to different orientations of the marker in the earth's field.

Although it is desirable that the resonant frequency is insensitive to the bias field, it is also desirable that there is a significant change in the resonant frequency when the bias magnet is demagnetized in order to deactivate the marker. Thus, the change of the resonant frequency upon deactivation should be at least about the bandwidth of the resonant curve i.e. larger than about 1.4 kHz in the aforementioned tone burst excitation mode. Table III lists the frequency change $\Delta f_r$ when the bias field is changed from about 6.5 to 2 Oe which is a measure of the frequency change upon deactivation. All the examples in Table III thus fulfill the typical deactivation requirement for a marker in said commercially available EAS systems.

The alloy composition $Fe_{24}Co_{18}Ni_{40}Si_2B_{16}$ is one example which is particularly suited for aforementioned EAS system. The inventive annealing technique provides this particular alloy composition with a significant higher magnetoresonant signal amplitude at even lower slope than is achievable by transverse annealing this or other alloys.

Effect of composition

In a second set of experiments, the inventive annealing technique were applied to a variety of different alloy compositions. Some representative examples were listed in Table I. Table IV lists their magnetoresonant properties when annealed with the inventive method as described above. For comparison, Table IV also lists the results obtained when annealing in a magnetic field across the ribbon width according to the prior art. Table V lists the figures of merit of the annealing method according to this invention. In all examples of Table III the ribbon was ductile after the annealing treatment. The resonant frequencies of the 38 mm ranged typically from about 50 to 60 kHz depending on the bias field H and the alloy composition.

TABLE IV

Examples of amorphous alloys listed in Table I which were annealed in a continuous mode according to the principles of the present invention (85° out-of-plane field of 2 kOe) and according to the principles of the prior art (transverse field of 2 kOe) at the indicated annealing temperature $T_a$ with speed a corresponding to an annealing time of about 6s $H_k$ is the anisotropy field, $H_{max}$ is the bias field where the resonant amplitude $A_1$ is maximum, $A_{max}$ is said maximum signal, $|df/dH|$ is the slope of the resonant frequency $f_r$ at $H_{max}$, $H_{fmin}$ is bias field where the resonant frequency has its minimum, $A_{fmin}$ is the signal at said minimum, $\Delta f_r$ is the difference of the resonant frequency at a bias of 2 Oe and 6.5 Oe, respectively.

| | | | results at maximum A1 | | | results at $f_{r,min}$ | | 6.5– |
|---|---|---|---|---|---|---|---|---|
| Alloy Nr. | $H_k$ (Oe) | $T_a$ (° C.) | $H_{max}$ (Oe) | $A_{max}$ (mV) | $\|df/dH\|$ (Hz/Oe) | $H_{fmin}$ (Oe) | $A_{fmin}$ (mV) | $\Delta f_r$ (kHz) |
| Examples annealed according to the principles of this invention | | | | | | | | |
| 1 | 370 | 10.7 | 6.3 | 89 | 652 | 9.3 | 59 | 2.3 |
| 2 | 360 | 10.8 | 7.0 | 88 | 662 | 9.5 | 52 | 2.1 |
| 3 | 340 | 9.8 | 6.5 | 83 | 654 | 8.5 | 55 | 2.4 |
| 4 | 360 | 8.0 | 4.9 | 91 | 797 | 6.8 | 64 | 3.0 |
| 5 | 360 | 9.8 | 5.0 | 97 | 1064 | 8.3 | 40 | 4.2 |
| 6 | 360 | 9.0 | 4.0 | 97 | 1388 | 7.3 | 42 | 6.0 |
| 7 | 340 | 7.1 | 2.5 | 80 | 1704 | 5.8 | 35 | 4.5 |
| 8 | 360 | 14.8 | 8.3 | 82 | 725 | 12.5 | 49 | 2.2 |
| 9 | 360 | 14.1 | 6.0 | 75 | 829 | 11.5 | 21 | 3.1 |
| Comparative examples annealed according to the prior art | | | | | | | | |
| 1 | 370 | 11.9 | 6.8 | 76 | 614 | 10.3 | 17 | 1.9 |
| 2 | 380 | 11.5 | 6.8 | 74 | 620 | 10.3 | 5 | 1.9 |
| 3 | 340 | 11.0 | 6.3 | 68 | 624 | 9.3 | 15 | 2.2 |
| 4 | 360 | 8.8 | 5.0 | 70 | 769 | 7.5 | 17 | 2.9 |
| 5 | 360 | 10.7 | 5.0 | 86 | 1024 | 9.0 | 8 | 3.9 |
| 6 | 360 | 9.8 | 4.3 | 93 | 1371 | 8.0 | 10 | 5.7 |
| 7 | 340 | 7.8 | 2.5 | 46 | 1519 | 6.25 | 12 | 4.8 |
| 8 | 360 | 16.4 | 8.8 | 80 | 702 | 14.3 | 11 | 1.8 |
| 9 | 360 | 15.3 | 6.3 | 77 | 729 | 12.8 | 10 | 26 |

TABLE V

Figures of merit for the examples listed in Table IV. The figure of merit is defined as the ratio of the resonant amplitude as after magnetic field annealing according to the principles of the present invention to the corresponding value obtained after magnetic field annealing according to the prior art. The column labeled with $A_{max}$ refers to the gain in maximum signal amplitude, the column labeled with $A_{fmin}$ refers to the signal amplitude at the bias where the resonant frequency has its minimum.

| | figures of merit | |
|---|---|---|
| Alloy Nr. | $A_{max}$ | $A_{fmin}$ |
| 1 | 1.17 | 3.5 |
| 2 | 1.19 | 10 |
| 3 | 1.22 | 3.7 |
| 4 | 1.30 | 3.8 |
| 5 | 1.13 | 5 |
| 6 | 1.04 | 4.2 |
| 7 | 1.74 | 2.9 |
| 8 | 1.03 | 4.5 |
| 9 | 0.97 | 21 |

The alloy compositions Nos. 1 to 7 are particularly susceptible to the annealing method of the invention and exhibit a considerably higher magnetoresonant signal amplitude than when conventionally annealed in a transverse field. Alloys Nos. 1–4 are even more preferred since they combine a high signal amplitude and a low slope $|df/dH|$ at the same time. Within this group, alloys Nos. 2–4 are still even more preferred since these properties are achieved with a significantly lower Co-content than in example 1, which reduces the raw material cost.

The alloy compositions Nos. 8 and 9 are less suitable for the inventive annealing conditions, since the enhancement in the maximum resonant amplitude is only marginal and within the experimental scatter. Alloy No. 9, moreover, has a rather high Co-content which is associated with high raw material cost.

One reason that alloys Nos. 8 and 9 were less susceptible to the inventive annealing process as performed in these experiments is related to their high saturation magnetization and their high Curie temperature. Both of those characteristics result in a considerably higher saturation magnetization at the annealing temperature. That is, the demagnetizing fields at the annealing temperature are higher, which requires higher annealing fields. Obviously the field strength of 2 kOe applied in this set of experiments was not high enough. Indeed, only when perpendicularly (85°) annealed in a higher field of about 5 kOe was alloy No. 8 susceptible again to the inventive annealing method and achieved a 10% increase of maximum signal amplitude. The same is expected for alloy 9, although not explicitly investigated. It is clearly advantageous, however, to have a good response at lower annealing field strengths, which is one reason why alloys Nos. 1–7 are preferred embodiments of the invention.

Guiding principles for the choice of alloy composition

Amorphous metals can be produced in huge variety of compositions with a wide range of properties. One aspect of the invention is to derive some guiding principles how to choose alloys out of this large variety of alloy ranges which are particularly suitable in magnetoelastic applications.

What is needed in such applications is a certain variation of the resonant frequency with the bias field and a good magnetoelastic susceptibility i.e. a high magnetoresonant signal amplitude.

According to Livingston, "Magnetomechanical Properties of Amorphous Metals", phys. stat. sol. (a) vol 70, pp 591–596 (1982) the resonant frequency for a transverse-annealed amorphous ribbon for $H<H_k$ can reasonably well be described as a function of the bias field by $$f_r(H) = \frac{f_r(H=0)}{\sqrt{1+\frac{9\lambda_s^2 E_s}{J_s H_K^2}H^2}} \tag{12}$$

where $\lambda_s$ is the saturation magnetostriction constant, $J_s$ is the saturation magnetization, $E_s$ is Young's modulus in the ferromagnetically saturated state, $H_K$ is the anisotropy field and H is the applied bias field.

Figure 24:
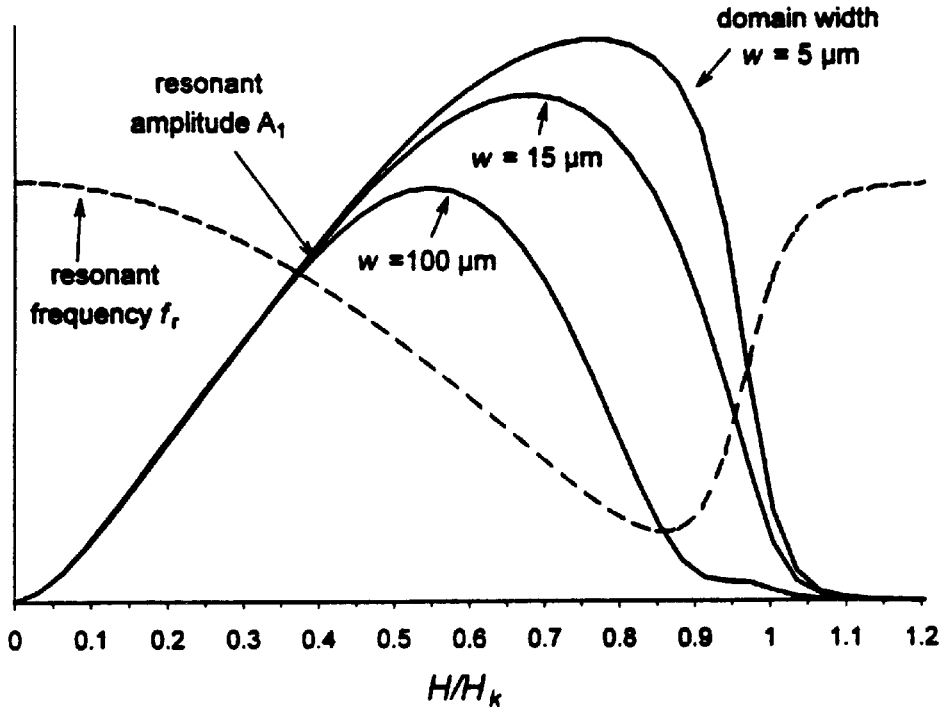
FIG. 24 is a schematic representation of the signal amplitude A1 versus the bias field for different domain widths and summarizes some fundamental aspects of the invention; the curve for the domain width of about 100 μm is typical for samples transversely field annealed according to the prior art and the curves shown for domain widths of about 5 and 15 μm are representative for the annealing technique according to the invention.

This relation also applies to the annealing technique according the principles of the present invention. The signal amplitude behaves as shown in FIG. 24, which shows the resonant frequency $f_r$ and the amplitude as a function of the bias field normalized to the anisotropy field $H_k$. The signal amplitude is significantly enhanced by domain refinement which is achieved with the annealing techniques described herein. This enhancement becomes particularly efficient when the sample is pre-magnetized with a field H larger than about 0.4 times the anisotropy field. As demonstrated in FIG. 24, this yields a significantly higher amplitude in a significantly wider bias field range than is obtainable when annealing in a transverse field according to the prior art.

For most applications it is advantageous to choose an alloy composition and an annealing treatment so that the ribbon has an anisotropy field such that the magnetic bias fields applied in the application range from about 0.3 times up to about 0.95 times the anisotropy field. Since the anisotropy field $H_k$ also includes the demagnetizing field of the sample along the ribbon axis, both alloy composition and heat treatment have to be adjusted to the length, width and thickness of the resonator strip. Following these principles and applying the annealing method of the invention, high resonant signal amplitudes can be achieved in a wide range of bias fields.

The actual choice of bias fields used in the applications depends upon various factors. Generally bias fields lower than about 8 Oe are preferable since this reduces energy consumption if the bias fields are generated with an electrical current by field coils. If the bias field is generated by a magnetic strip adjacent to the resonator, the necessity for low bias fields arises from the requirement of low magnetic clamping of the resonator and the bias magnet, as well as from the economical requirement to form the bias magnet with a small amount of material.

Alloys Nos. 1 to 7 of Table I, according to the examples in Table IV, generally has low anisotropy fields of about 6 Oe to 11 Oe and, thus, are optimally operable at smaller bias fields than alloys Nos. 8 and 9 which typically reveal a high anisotropy field of about 15 Oe. This is another reason why alloys Nos. 1–7 are preferred.

The requirement for a certain level of the resonant frequency is easily adjusted by choosing an appropriate length of the resonator. Another application requirement is a well-defined susceptibility of the resonant frequency to the magnetic bias field. The latter corresponds to the slope $|df_r/dH|$, which from eq. (12) can be derived as $$\left|\frac{df_r}{dH}\right| = f_r H \frac{9\lambda_s^2 E_s}{J_s H_K^3}\left(1+\frac{9\lambda_s^2 E_s}{J_s H_K^3}H^2\right) \sim F_r H \frac{9\lambda_s^2 E_s}{J_s H_K^3}. \tag{13}$$

When the bias field range H and accordingly $H_k$ has been chosen, the desired frequency slope $|df_r/dH|$ is primarily determined by the saturation magnetostriction $\lambda_s$ (which out of the remaining free parameters shows the largest variation with respect to the alloy composition). Hence, the desired susceptibility of the resonant frequency to the bias field can be adjusted by choosing an alloy composition with an appropriate value of the saturation magnetostriction, which can be estimated from eq. (13).

In a marker used for a leading commercially available EAS system, a low slope |dfr/dH| is required, as described in more detail above. At the same time, a moderate anisotropy field is required so that the marker is optimally operable at reasonably low bias fields. Thus, it is advantageous to choose an alloy composition with a magnetostriction of less than about 15 ppm. This is another the reason why alloys Nos. 1 through 4 are particularly suitable for this application. The magnetostriction should be at least a few ppm in order to guarantee a magnetoelastic response at all. A magnetostriction of more than about 5 ppm is further required to guarantee sufficient change in frequency when the marker is deactivated.

A low but finite value of magnetostriction can be achieved by choosing an alloy with an Fe content of less than about 30 at % but at least about 15 at % and simultaneously adding a combined portion of Ni and Co of at least about 50 at %.

Other applications such as electronic identification systems or magnetic field sensors rather require a high sensitivity of the resonant frequency to the bias field i.e. in such case a high value of |df/dH|>1000 Hz/Oe is required. Accordingly, it is advantageous to choose an alloy with a magnetostriction larger than about 15 ppm as exemplified by alloys Nos. 5 through 7 of Table I. At the same time the alloy should have a sufficiently low anisotropy field, which is also necessary for a high susceptibility of $f_r$ to the bias field.

In any case the resonator, when annealed according to the principles of this invention exhibits an advantageously higher resonant signal amplitude over a wider field range than resonators of the prior art.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for making a resonator for use in a marker containing a bias element, which produces a bias magnetic field, in a magnetomechanical electronic article surveillance system, said method comprising the steps of:

providing a planar ferromagnetic ribbon composed of an amorphous alloy having a thickness and a ribbon axis extending along a longest dimension of said ferromagnetic ribbon, and a ribbon plane;

annealing said ferromagnetic ribbon and by said annealing producing in said ferromagnetic ribbon a fine domain structure having a maximum width selected from the group consisting of 40 $\mu$m and 1.5 times said thickness, an anisotropy with a component out of said ribbon plane, and an induced magnetic easy axis substantially perpendicular to said ribbon axis; and cutting a piece of said annealed ferromagnetic ribbon to form a resonator.

2. A method as claimed in claim 1 wherein the step of annealing comprises annealing said ferromagnetic ribbon in a magnetic field having a substantial component normal to a plane containing said planar ferromagnetic ribbon during annealing.

3. A method as claimed in claim 2 wherein the step of annealing said ferromagnetic ribbon comprises annealing said ferromagnetic ribbon in a magnetic field having, in addition to said substantial component normal to said plane containing said planar ferromagnetic ribbon, a component in said plane containing said ferromagnetic ribbon and transverse to said ribbon axis and a smallest component along said element ribbon for causing said fine domain structure to be regularly oriented transverse to said element ribbon.

4. A method as claimed in claim 1 wherein the step of annealing comprises annealing said ferromagnetic ribbon for giving said ferromagnetic ribbon a magnetic behavior characterized by a hysteresis loop which is linear up to a magnetic field substantially equal to a magnetic field which ferromagnetically saturates said ferromagnetic ribbon.

5. A method as claimed in claim 1 wherein the step of providing a planar ferromagnetic ribbon comprises providing a planar amorphous ribbon having a composition $Fe_aCo_bNi_cSi_xB_yM_z$ wherein a, b, c, y, x, and z are in at %, wherein M is at least one glass formation promoting element selected from the group consisting of C, P, Ge, Nb, Ta and Mo and/or at least one transition metal selected from the group consisting of Cr and Mn and wherein $15<a<75$ $0<b<40$ $0\leqq c<50$ $15<x+y+z<25$ $0\leqq z<4$ so that $a+b+c+x+y+z=100$.

6. A method as claimed in claim 1 wherein the step of providing a planar ferromagnetic ribbon comprises providing a planar amorphous ribbon having a composition $Fe_aCo_bNi_cSi_xB_yM_z$ wherein a, b, c, y, x, and z are in at %, wherein M is at least one glass formation promoting element selected from the group consisting of C, P, Ge, Nb, Ta and Mo and/or at least one transition metal selected from the group consisting of Cr and Mn and wherein $15<a<30$ $10<b<30$ $20<c<50$ $15<x+y+z<25$ $0<z<4$ so that $a+b+c+x+y+z=100$.

7. A method as claimed in claim 1 wherein the step of providing a planar ferromagnetic ribbon comprises providing a planar amorphous ribbon having a composition $Fe_aCo_bNi_cSi_xB_yM_z$ wherein a, b, c, y, x, and z are in at %, wherein M is at least one glass formation promoting element selected from the group consisting of C, P, Ge, Nb, Ta and Mo and/or at least one transition metal selected from the group consisting of Cr and Mn and wherein $15<a<27$ $10<b<20$ $30<c<50$ $15<x+y+z<20$ $0<x<6$ $10<y<20$ $0<z<3$ so that $a+b+c+x+y+z=100$.

8. A method as claimed in claim 1 wherein the step of providing a planar ferromagnetic element comprises providing a planar amorphous ribbon having a composition $Fe_{24}Co_{18}Ni_{40}Si_2B_{16}$.

9. A method as claimed in claim 1 wherein the step of providing a planar ferromagnetic element comprises providing a planar amorphous ribbon having a composition $Fe_{24}Co_{16}Ni_{43}Si_1B_{16}$.

10. A method as claimed in claim 1 wherein the step of providing a planar ferromagnetic element comprises providing a planar amorphous ribbon having a composition $Fe_{23}Co_{15}Ni_{45}Si_1B_{16}$.

11. A method as claimed in claim 1 wherein the step of cutting a piece from said annealed ferromagnetic ribbon to form a resonator comprises cutting a strip from said annealed ferromagnetic ribbon to form a resonator.

12. A method as claimed in claim 1 wherein the step of cutting a piece from said annealed ferromagnetic element to form a resonator comprises cutting a circular piece from said annealed ferromagnetic ribbon to form a resonator.

13. A method as claimed in claim 1 wherein said ribbon has a top surface and a bottom surface, and wherein the step of annealing comprising introducing crystallinity into said ribbon to a depth of about 10% of the thickness of said ribbon from said top surface and to a depth of about 10% of the thickness of said ribbon from said bottom surface.

* * * * *